US012595793B2

(12) United States Patent
Yamamoto et al.

(10) Patent No.: US 12,595,793 B2
(45) Date of Patent: Apr. 7, 2026

(54) COMPRESSOR

(71) Applicant: Hitachi Industrial Equipment Systems Co., Ltd., Tokyo (JP)

(72) Inventors: Akihiro Yamamoto, Tokyo (JP); Yoshiyuki Kanemoto, Tokyo (JP); Zhijia Ren, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 245 days.

(21) Appl. No.: 18/273,833

(22) PCT Filed: Jan. 14, 2022

(86) PCT No.: PCT/JP2022/001173
§ 371 (c)(1),
(2) Date: Jul. 24, 2023

(87) PCT Pub. No.: WO2022/230252
PCT Pub. Date: Nov. 3, 2022

(65) Prior Publication Data

US 2024/0301882 A1 Sep. 12, 2024

(30) Foreign Application Priority Data

Apr. 28, 2021 (JP) ..... 2021-076348

(51) Int. Cl.
*F04B 49/02* (2006.01)
*F04B 41/06* (2006.01)
*F04B 51/00* (2006.01)

(52) U.S. Cl.
CPC ..... *F04B 49/02* (2013.01); *F04B 41/06* (2013.01); *F04B 51/00* (2013.01);
(Continued)

(58) Field of Classification Search
CPC ..... F04B 49/02; F04B 49/065; F04B 49/007; F04B 51/00; F04B 41/06; F04D 27/001;
(Continued)

(56) References Cited

U.S. PATENT DOCUMENTS 4,502,842 A * 3/1985 Currier ..... F04B 49/065 417/63
7,207,183 B2 * 4/2007 Crane ..... F25B 49/025 62/185

(Continued)

FOREIGN PATENT DOCUMENTS

CN 2133694 Y 5/1993
CN 102536768 A 7/2012

(Continued)

OTHER PUBLICATIONS

Japanese Office Action issued on Apr. 22, 2025 for Japanese Patent Application No. 2021-076348.

(Continued)

*Primary Examiner* — Thomas Fink
(74) *Attorney, Agent, or Firm* — Volpe Koenig

(57) ABSTRACT

Provided is a compressor including a compressor unit that includes a compressor body that compresses gas and a motor that drives the compressor body, and a controller that carries out the operation number control for a plurality of the compressor units. The plurality of compressor units are connected to the same pipe. The controller causes, while continuing the operation number control for the compressor units that are a target of the operation number control, the compressor unit excluded from the target of the operation number control to start.

11 Claims, 12 Drawing Sheets

(52) U.S. Cl.
CPC .... *F04C 2240/40* (2013.01); *F04C 2270/051* (2013.01); *F04C 2270/56* (2013.01); *F04C 2270/80* (2013.01)

(58) Field of Classification Search
CPC .... F04D 27/00; F04D 27/008; F04D 27/0292; F04D 25/16; F04C 28/06; F04C 28/28; F04C 2270/70; F04C 2270/701; F04C 2270/56; F04C 2270/051
See application file for complete search history.

(56) References Cited

U.S. PATENT DOCUMENTS

| | | | | |
|---|---|---|---|---|
| 2004/0016241 | A1* | 1/2004 | Street | G05D 23/1917 62/157 |
| 2007/0056300 | A1* | 3/2007 | Crane | F25B 49/025 62/175 |
| 2007/0157650 | A1 | 7/2007 | Takegami et al. | |
| 2009/0110562 | A1* | 4/2009 | Huang | F04B 49/065 417/44.1 |
| 2015/0370265 | A1 | 12/2015 | Ren et al. | |
| 2017/0035064 | A1 | 2/2017 | Lee | |
| 2017/0350649 | A1* | 12/2017 | Hirao | F25J 1/0279 |

FOREIGN PATENT DOCUMENTS

| | | | |
|---|---|---|---|
| JP | 58-091386 | A | 5/1983 |
| JP | 61-218788 | A | 9/1986 |
| JP | H08-327166 | A | 12/1996 |
| JP | 2011058798 | A | 3/2011 |
| JP | 2012-225349 | A | 11/2012 |
| JP | 2014185819 | A | 10/2014 |
| JP | 2016-125772 | A | 7/2016 |
| WO | 2006/051853 | A1 | 5/2006 |
| WO | 2014/122764 | A1 | 8/2014 |

OTHER PUBLICATIONS

International Search Report, PCT/JP2022/001173, Feb. 22, 2022, 6 pgs.
Chinese Office Action dated Jan. 28, 2026 for Chinese Patent Application No. 202280013001.2.

* cited by examiner

FIG.12

| STOP FLAG | EXECUTION POSSIBILITY OF TEST OPERATION PROCESSING |
|---|---|
| TEMPERATURE ABNORMALITY STOP FLAG | POSSIBLE |
| CURRENT ABNORMALITY STOP FLAG | IMPOSSIBLE |
| MAINTENANCE STOP FLAG | IMPOSSIBLE |
| HIGH-VOLTAGE ABNORMALITY STOP FLAG | IMPOSSIBLE |
| LOW-VOLTAGE ABNORMALITY STOP FLAG | POSSIBLE |

COMPRESSOR

TECHNICAL FIELD

The present invention relates to a compressor.

BACKGROUND ART

There has been known a compressor which generates compressed gas used as a power source of a pneumatic actuator for machine tools such as a press machine in a production line and compressed gas used for air tools such an air blow gun and an air drill. In Patent Document 1, there is such a description that a plurality of compressor units (compression modules) are connected in parallel, only a compressor unit which is a target of maintenance is brought into an operation stop state, and the maintenance of this compressor unit is carried out while continuing operation of a system.

PRIOR ART DOCUMENT

Patent Document

Patent Document 1: JP-2016-125772-A

SUMMARY OF THE INVENTION

Problem to be Solved by the Invention

In the technology described in Patent Document 1, when the maintenance is carried out for a compressor unit which has been stopped due to abnormality detection or the like, the operation of the other compressor units can be continued during the maintenance. However, no description is given of control for the compressor unit which stopped due to the abnormality detection or the like at the time when a test operation for checking whether or not this compressor unit normally operates is carried out.

In general, in a compressor provided with a plurality of compressor units driven by the same power supply, when a failure of the compressor unit occurs, the operation of this failed compressor unit is caused to stop. This compressor unit undergoes a test operation after inspection and replacement, and is added again to the normal operation. On this occasion, all of the compressor units are supplied with the electric power from the same power supply and hence even when the operation of this compressor unit is stopped, components thereof are in an energized state. Replacement of a component and the like in the energize state likely impair safety of a worker. Thus, it is often the case that the entire compressor is temporarily stopped and a failed portion is then replaced.

However, depending on the type of the failure, there is such a case that replacement of a component or inspection by the hand contact is not required. In this case, after it is confirmed that the predetermined compressor unit is normal in the test operation, the normal operation by the entire compressor is resumed. As described above, when it is required to temporarily cause the entire compressor to stop in order to carry out the test operation, there is a room for improvement in terms an increase in operating rate of the compressor.

Means for Solving the Problem

A compressor according to one aspect of the present invention includes a compressor unit that includes a compressor body that compresses gas and a motor that drives the compressor body, and a controller that carries out operation number control for a plurality of the compressor units, in which the plurality of compressor units are connected to the same pipe, and the controller is configured to cause, while continuing the operation number control for the compressor units that are a target of the operation number control, the compressor unit excluded from the target of the operation number control to start.

Advantages of the Invention

According to the present invention, when a predetermined compressor unit stops due to abnormality detection or the like, the predetermined compressor unit can be caused to start, can be caused to carry out the operation without interfering the operation-number-control operation for the other compressor units, and can then be included into the operation-number-control operation after the predetermined compressor unit is confirmed to be normal. When the test operation of the predetermined compressor unit is to be carried out, the operation-number-control operation for the other compressor units is not interfered and hence the operating rate of the compressor can be increased.

BRIEF DESCRIPTION OF THE DRAWINGS

FIG. 12 is a table for showing a relation between a stop flag and execution possibility of test operation processing stored in the controller according to a modification example 1.

MODES FOR CARRYING OUT THE INVENTION

A description is now given of a compressor according to embodiments of the present invention with reference to drawings.

First Embodiment

Figure 1:
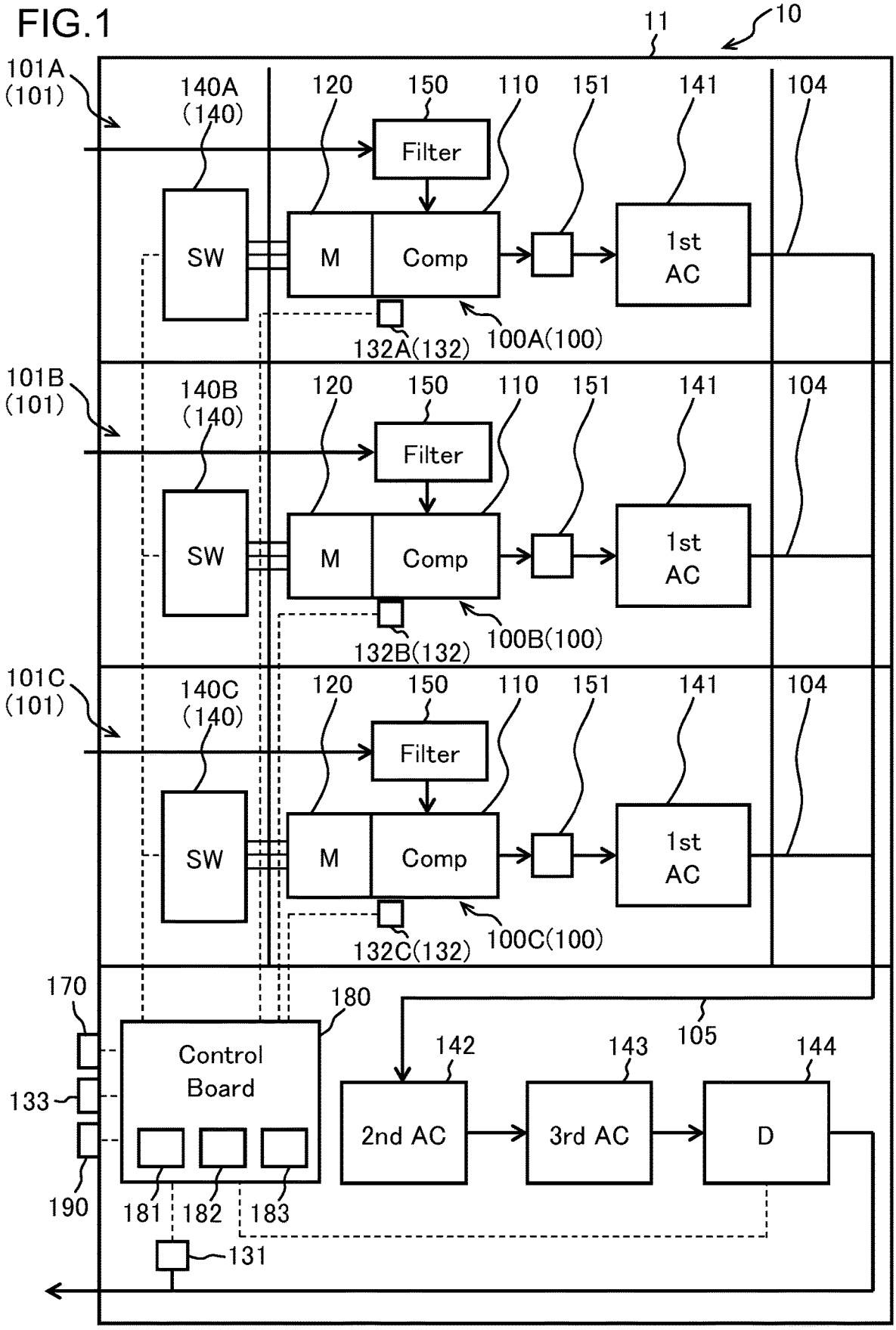
FIG. 1 is a diagram for showing a configuration of a compressor according to a first embodiment.

FIG. 1 is a diagram for showing a configuration of a compressor 10 according to a first embodiment of the present invention. As shown in FIG. 1, the compressor 10 according to the first embodiment of the present invention is provided with three compression modules 101A, 101B, and 101C which generate compressed gas such as compressed air, a main delivery pipe 105 to which the compressed gas delivered from the three compression modules 101A, 101B, and 101C is supplied, a second after-cooler 142 provided on the main delivery pipe 105, a third after-cooler 143 provided on a downstream side of the second after-cooler 142 on the main delivery pipe 105, a dryer 144 provided on a downstream side of the third after-cooler 143 on the main delivery pipe 105, a pressure sensor 131 provided on a downstream side of the dryer 144 on the main delivery pipe 105, a controller (control board) 180 which carries out operation number control for the three compression modules 101*a*, 101B, and 101C, and a package housing 11 which accommodates many of these components.

Any one of the plurality of compression modules 101A, 101B, and 101C, the controller 180, and other electric components accommodated in the package housing 11 is supplied with electric power from the same power supply (not shown) outside the package housing 11. A power supply path from the power source branches inside the package housing 11 and is connected to the plurality of compression modules 101A, 101B, and 101C, the controller 180, and the other electric components.

The three compression modules 101A, 101B, and 101C have the same configuration, and are generally referred to as compression modules 101. The compression module 101 is provided with a compressor unit 100 which includes a compressor body 110 and a motor 120, an electromagnetic switch 140 which switches between supply and interrupt of the electric power to the motor 120, a filter 150 which is connected a suction port of the compressor body 110 and catches foreign matters, a module pipe 104 to which the compressed gas delivered from the compressor body 110 is supplied, a check valve 151 provided on the module pipe 104, and a first after-cooler 141 provided on a downstream side of the check valve 151 on the module pipe 104. The check valve 151 allows a flow of the gas directed from the compressor body 110 to the first after-cooler 141 and prohibits a flow of the gas directed from the first after-cooler 141 to the compressor body 110. Thus, the check valve 151 prevents the compressed gas from flowing back from the main delivery pipe 105 side to the compressor body 110 when the compression module 101 stops. The module pipes 104 of the three compression module 101 are connected to the same main delivery pipe 105.

To the controller 180 are connected the electromagnetic switches 140, the dryer 144, an operation panel 170, a communication device 190, the pressure sensor 131, a temperature sensor 132, and an ambient temperature sensor 133. The pressure sensor 131 senses a delivery pressure of the compressor 10 and outputs a result of this sensing to the controller 180. The temperature sensor 132 senses the temperature of the compressor body 110 and outputs a result of this sensing to the controller 180. The ambient temperature sensor 133 senses the temperature of an ambience of the compressor 10 and outputs a result of this sensing to the controller 180.

The controller 180 is formed of a computer including a processor 181 such as a CPU (Central Processing Unit), an MPU (Micro Processing Unit), and a DSP (Digital Signal Processor), a nonvolatile memory 182 such as a ROM (Read Only Memory), a flash memory, and a hard disk drive which is a magnetic storage device, a volatile memory 183 which is a so-called RAM (Random Access Memory), an input interface, an output interface, and other peripheral circuits. Note that, the controller 180 may be formed of one computer or may be formed of a plurality of computers.

In the nonvolatile memory 182 is stored information such as programs and data required to carry out various types of processing including a control program for implementing the operation number control and the like. That is, the nonvolatile memory 182 is a storage medium (storage device) from which the programs for implementing functions of the present embodiment can be read. The processor 181 is a processing device that expands, on the volatile memory 183, the program stored in the nonvolatile memory 182 and executes this program for computation, and applies predetermined computation processing to data input from the input interface, the nonvolatile memory 182, and the volatile memory 183 in accordance with the program.

The input interface converts signals input from the operation panel 170, the communication device 190, the pressure sensor 131, the temperature sensor 132, the ambient temperature sensor 133, the electromagnetic switches 140, and the like to data which can be computed in the processor 181. Moreover, the output interface generates a signal for output in accordance with a computation result in the processor 181 and outputs this signal to the electromagnetic switches 140, the dryer 144, the communication device 190, and the like.

The controller 180 controls the first electromagnetic switch 140A to cause the first compressor unit 100A to operate at a constant speed or to stop. The controller 180 controls the second electromagnetic switch 140B to cause the second compressor unit 100B to operate at a constant speed or to stop. The controller 180 controls the third electromagnetic switch 140C to cause the third compressor unit 100C to operate at a constant speed or to stop. The electromagnetic switch 140 includes an electromagnetic contactor and a thermal relay (thermally activated relay). The thermal relay detects an overcurrent flowing through the motor 120 to activate a contact, thereby stopping the motor 120. As a result, burnout of the motor 120 is prevented. The detection signal of the overcurrent by the thermal relay is output to the controller 180. The controller 180 senses the overcurrent of the motor 120 on the basis of the detection signal from the thermal relay.

The compressed gas delivered from the compressor unit 100 passes through the check valve 151 and is supplied to the first after-cooler 141. The compressed gas cooled by the first after-cooler 141 is supplied to the main delivery pipe 105 via the module pipe 104. That is, the portions of compressed gas delivered from the first to third compressor units 100A to 100C merge with one another in the main delivery pipe 105. The compressed gas is then supplied to the second after-cooler 142 and is cooled. The compressed gas cooled in the second after-cooler 142 is supplied to the third after-cooler 143 and is then cooled. The compressed gas cooled in the third after-cooler 143 is supplied to the dryer 144. The dryer 144 dehumidifies the compressed gas by heat exchange with a cooling wind. That is, the dryer 144 is a heat exchanger which removes drain from the compressed gas. The compressed gas dehumidified in the driver 144 is led from a device output portion to an external tank (not shown). The tank is connected to a pneumatic device via an output pipe and the compressed gas is supplied toward the pneumatic device by opening and closing a valve device provided to the output pipe, which is not shown. The pneumatic device is, for example, a pneumatic actuator used for a machine tool or an air tool such as air blow gun and an air drill.

Figure 2:
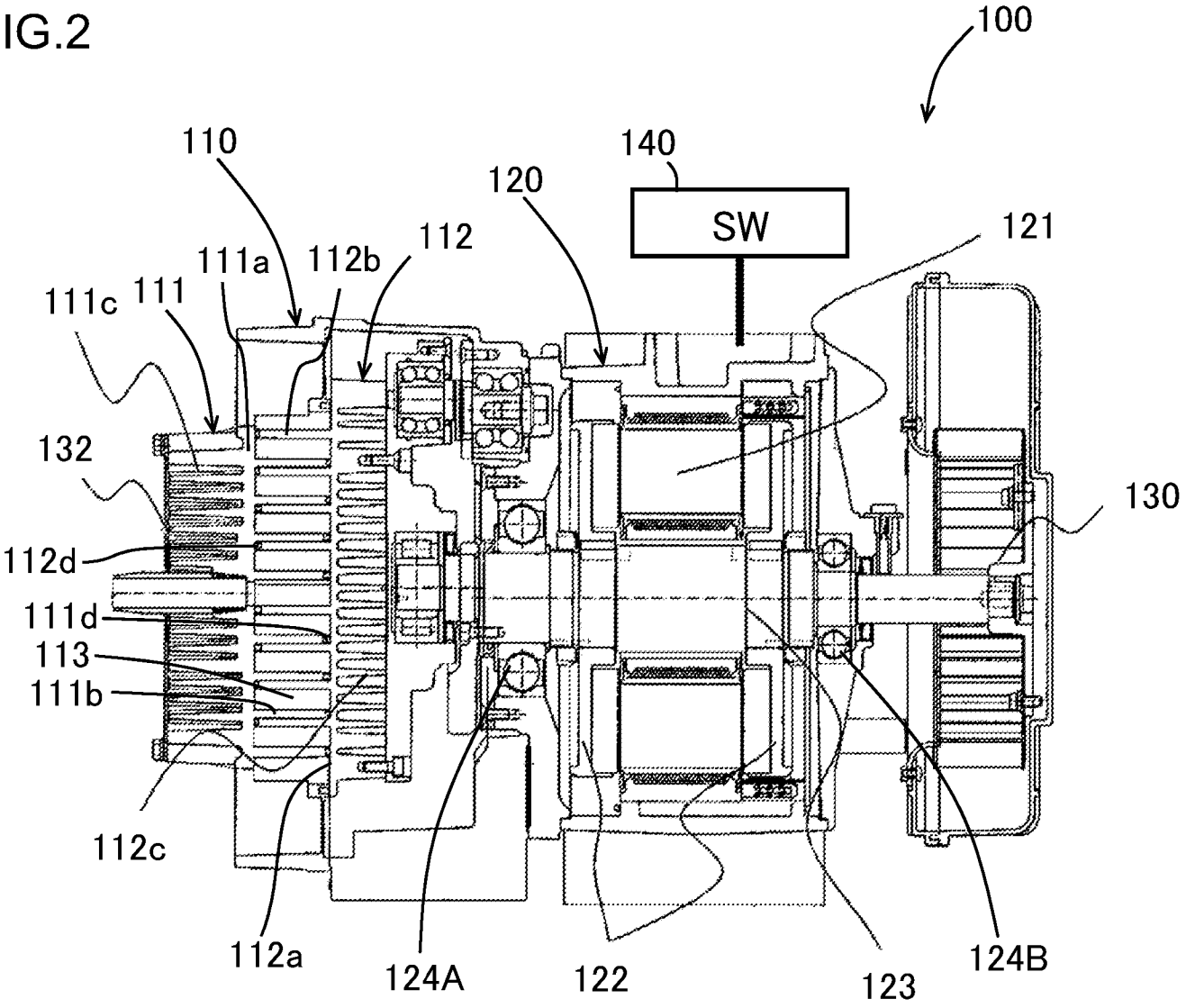
FIG. 2 is a schematic cross-sectional view of a compressor unit.

With reference to FIG. 2, a configuration of the compressor unit 100 is described. FIG. 2 is a schematic cross-sectional view of the compressor unit 100. As shown in FIG. 2, the compressor unit 100 includes the compressor body 110 which compresses the gas such as the air, the motor (electric motor) 120 which drives the compressor body 110, and a cooling fan 130 which generates cooling wind. The compressor body 110 according to the present embodiment compresses the gas by a compression type called scroll type. The compressor body 110 includes a fixed scroll 111 and an orbiting scroll 112 which are arranged so as to oppose to each other, forms a compression chamber 113 between the fixed scroll 111 and the orbiting scroll 112, and compresses the air in the compression chamber 113 by the orbiting motion.

The fixed scroll 111 includes an end plate 111*a* formed into a disk shape, a wrap portion 111*b* in a spiral shape provided so as to protrude from the end plate 111*a* toward the motor 120 side, and a plurality of cooling fins 111*c* provided so as to protrude from the end plate 111*a* toward the opposite side of the motor 120 side.

The orbiting scroll 112 includes an end plate 112*a* formed into a disk shape, a wrap portion 112*b* in a spiral shape provided so as to protrude from the end plate 112*a* toward the fixed scroll 111 side, and a plurality of cooling fins 112*c* provided so as to protrude from the end plate 112*a* toward the motor 120 side.

On a distal end surface of the warp portion 111*b* of the fixed scroll 111 is provided a tip seal 111*d* which is a seal member for sealing a gap between the distal end surface of the wrap portion 111*b* and the end plate 112*a* of the orbiting scroll 112. On a distal end surface of the warp portion 112*b* of the orbiting scroll 112 is provided a tip seal 112*d* which is a seal member for sealing a gap between the distal end surface of the wrap portion 112*b* and the end plate 111*a* of the fixed scroll 111.

The compression chamber 113 is formed between the wrap portion 111*b* of the fixed scroll 111 and the wrap portion 112*b* of the orbiting scroll 112 and is maintained air-tight by the tip seals 111*d* and 112*d*. The compression chamber 113 is continuously reduced between the wrap portions 111*b* and 112*b* while moving from the outside in the radial direction of the wrap portions 111*b* and 112*b* toward the inside in the radial direction thereof when the orbiting scroll 112 presents the orbiting motion in a forward direction. As a result, the gas supplied from the outside to the compression chamber 113 is compressed and the compressed gas is delivered from a delivery port at the center of the wrap to the module pipe 104 (see FIG. 1).

The motor 120 is provided with a stator 121 formed by mounting a stator coil to a stator core, a rotor 122 arranged with a gap to the stator 121, and a shaft 123 fixed to the rotor 122. The stator 121 and the rotor 122 are accommodated in a motor housing and the shaft 123 is rotatably supported by bearings 124A and 124B provided to the motor housing. A rotating magnetic field is formed by supplying AC power supplied from the power supply, not shown, to the stator coil via the electromagnetic switch 140 and the rotor 122 rotates together with the shaft 123.

Note that, the motor 120 according to the present embodiment is a motor of the axial gap type and is configured to coaxially drive the compressor body 110, but the type of the motor 120 is not limited to this type. As the motor 120, a motor of the radial gap type such as the inner rotor type or the outer rotor type or the liner type may be used.

The power of the motor 120 is transmitted to the orbiting scroll 112 and the cooling fan 130 via the shaft 123. As a result of the rotation of the motor 120, the orbiting scroll 112 rotates thereby compressing the gas and the cooling fan 130 rotates thereby generating the cooling wind. The cooling wind flows toward the motor 120 and the compressor body 110 thereby cooling the motor 120 and the compressor body 110. Note that, there may be provided a member (a duct or the like) which guides the cooling wind such that the cooling wind generated by the cooling fan 130 flows to the cooling fin 111*c* of the fixed scroll 111 and the cooling fin 112*c* of the orbiting scroll 112.

The temperature sensor 132 for sensing the temperature of the compressor body 110 is provided to the cooling fin 111*c* of the fixed scroll 111.

Figure 3:
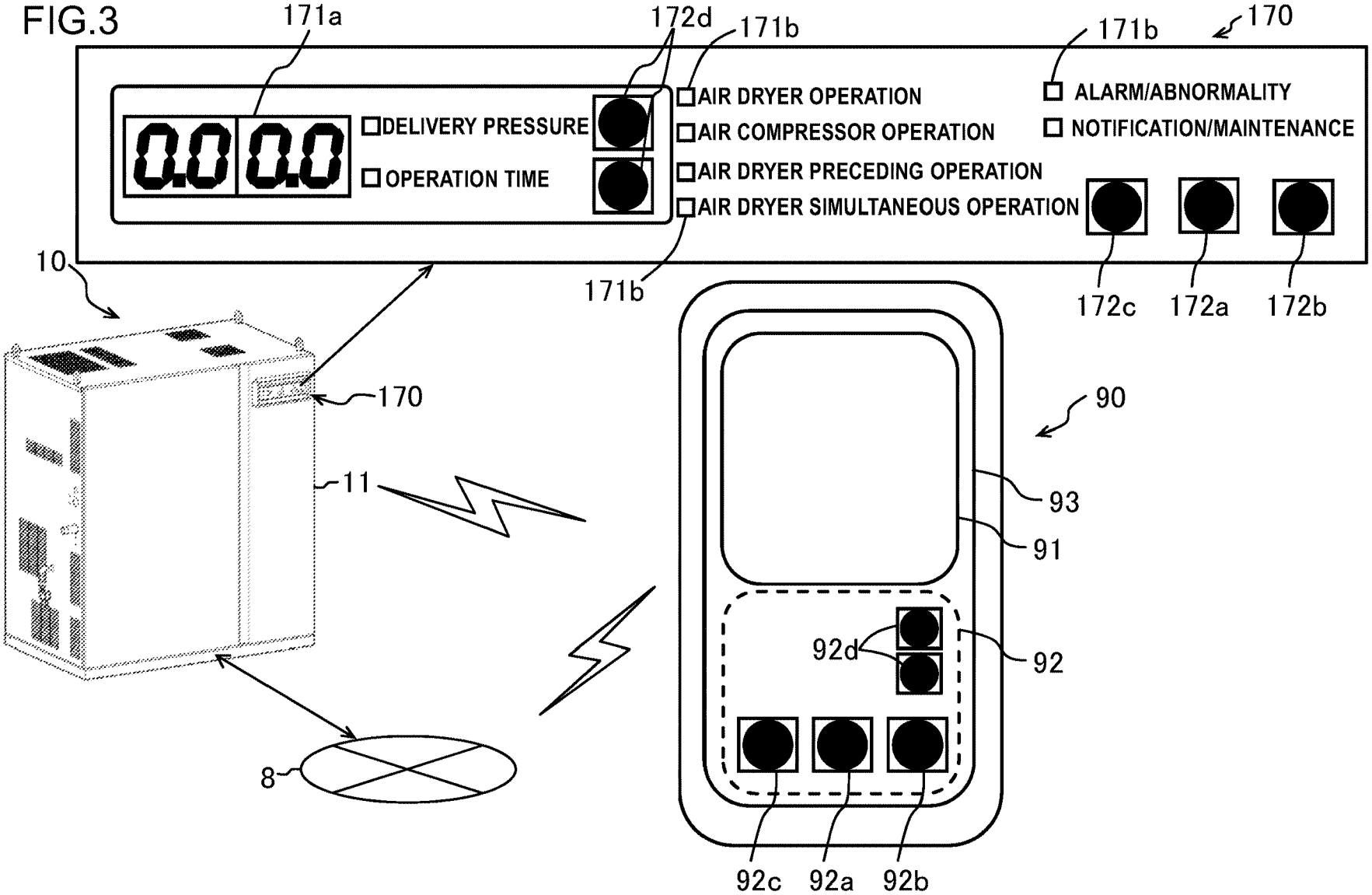
FIG. 3 is a view for illustrating an operation method of the compressor.

With reference to FIG. 3, an operation method of the compressor 10 is described. As shown in FIG. 3, the operation panel 170 is attached on a front side of the package housing 11 of the compressor 10. The operation panel 170 includes a plurality of display units 171*a* and 171*b* which notify the user of a state of the compressor 10. The display unit 171*a* is a digital display such as a liquid crystal display and displays the delivery pressure of the compressor 10 sensed by the pressure sensor 131, an operation time of the compressor 10, and the like. Note that, the display unit 171*a* may be a 7-segment display including a plurality of 7-segment LEDs (light emitting diodes). The plurality of display units 171*b* are formed of LEDs and the like. The display unit 171*b*, for example, turns on or flashes in predetermined colors, thereby notifying the user of an operation state of the compressor 10, a control mode being selected, presence or absence of an abnormality of the compressor 10, and the like.

The operation panels 170 include a plurality of operation switches 172*a* to 172*d* operated by the user. The plurality of operation switches 172*a* to 172*d* include a run switch 172*a* for instructing start of the operation, a stop switch 172*b* for instructing stop of the operation, a menu switch 172*c* for instructing a change in setting, and the display changeover switch 172*d* for switching a display content of the display unit 171*a*.

The user operates the operation switches 172*a* to 172*d* of the operation panel 170, thereby being capable of starting, stopping, and changing setting of the operation of the compressor 10, and switching the display content of the display unit 171*a*. Note that, in the present embodiment, it is possible to use an information terminal 90 which wirelessly communicates with the compressor 10, thereby being capable of operating the compressor 10. The information terminal 90 is one of various portable terminals such as a smartphone, a tablet, and a wearable device which the user can carry.

An application for compressor for monitoring the operation state of the compressor 10, remotely operating the compressor 10, and the like is installed on the information terminal 90. The compressor 10 and the information terminal 90 communicate mutual information with each other via the wireless communication. The communication device 190 (see FIG. 1) of the compressor 10 includes a communication interface including a communication antenna having, as a sensitivity band, a predetermined frequency band.

As a communication method between the compressor 10 and the information terminal 90, various methods can be employed. For example, the compressor 10 and the information terminal 90 may transmit and receive information via a communication line 8, which is a wide area network. Note that, the communication line 8 is the Internet, a cellular phone communication network (mobile communication network) such as a 4G or 5G communication network, a LAN (Local Area Network), a WAN (Wide Area Network), or the like. Moreover, the compressor 10 and the information terminal 90 can employ the Bluetooth (registered trademark) as a near-field wireless communication which allows direct transmission and reception of information without routing through the communication line 8. Note that, the near-field wireless communication method is not limited to the Bluetooth, but a communication method such as the Wi-Fi (registered trademark) and the ZigBee (registered trademark) can be employed.

The information terminal 90 can control the operation of the compressor 10 by starting the installed application for compressor and carrying out a predetermined operation on a touch panel 93 of the information terminal 90. The information terminal 90 displays a display content similar to the display content of the display units 171*a* and 171*b* of the operation panel 170 in a state display area 91 in the touch panel 93 which functions as both of a display unit and an input unit. Moreover, the information terminal 90 displays, in an operation area 92 of the touch panel 93, a run switch 92*a*, a stop switch 92*b*, a menu switch 92*c*, and a display changeover switch 92*d* similar to the operation switches 172*a* to 172*d* of the operation panel 170. A user of the information terminal 90 touch-operates the operation switches 92*a* to 92*d*, thereby being capable of starting, stopping, and changing the setting of the operation of the compressor 10 and switching the display content of the touch panel 93.

Note that, the information terminal 90 may be a dedicated information terminal which carries out only the operation and the monitoring of the compressor 10. In this case, the operation panel 170 configured to be detachable from the package housing 11 can also be used as the information terminal 90. Note that, the operation method by the operation panel 170 and the operation method by the information terminal 90 are similar to each other. Thus, as a representative, a description is now given of a control content of the controller 180 based on the operation on the operation panel 170, and there is omitted a description of a control content of the controller 180 based on the operation on the information terminal 90.

Figure 4:
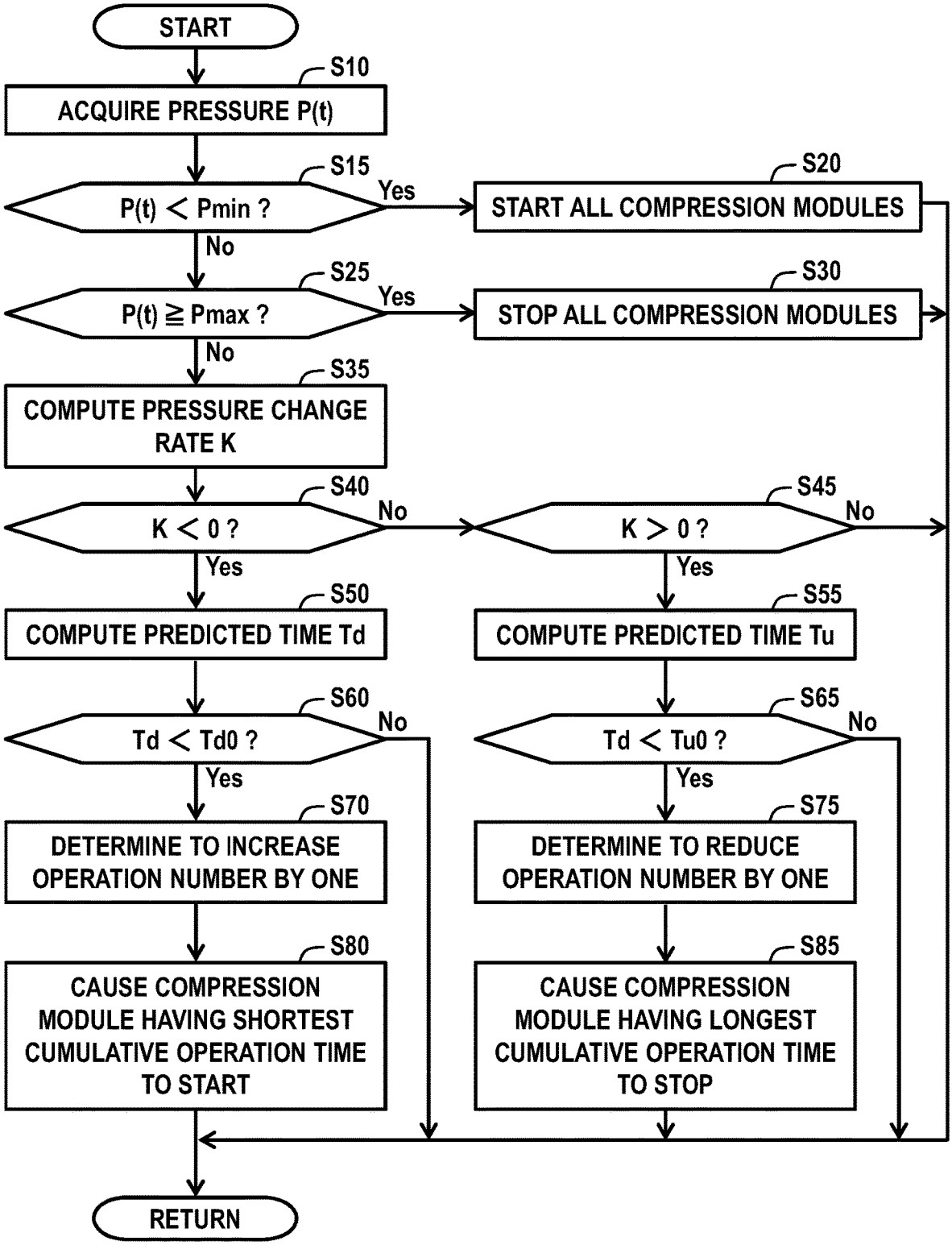
FIG. 4 is a flowchart for showing an example of operation number control carried out by a controller.

With reference to FIG. 1 and FIG. 4, a description is now given of the operation number control carried out by the controller 180. The controller 180 shown in FIG. 1 has a function of storing the pressure sensed by the pressure sensor 131, a function of measuring and storing a cumulative operation time of each of the compressor units 100, and a function of causing the motors 120 to operate and to stop. The pressure sensor 131 is provide to the main delivery pipe 105 connected to a tank (not shown). That is, the pressure sensed by the pressure sensor 131 is approximately the same value as a pressure in the tank.

The controller 180 outputs operation commands to the electromagnetic switches 140A to 140C to operate the electromagnetic switches 140A to 140C, thereby causing the motors 120 of the compressor units 100A to 100C to rotate at a constant speed. The controller 180 individually outputs the operation command to each of the electromagnetic switches 140A to 140C thereby individually causing the compression modules 101A to 101C to operate. For example, the controller 180 can select one of the compression modules 101A to 101C and can cause the selected one compressor module to operate, can select two of the compression modules 101A to 101C and can cause the selected two compressor modules to operate, and can select all of the compression modules 101A to 101C and can cause the selected all compressor modules to operate.

In the operation number control, the controller 180 controls the operation number of the compression modules 101 such that the pressure sensed by the pressure sensor 131 is maintained within a pressure range from a lower limit pressure Pmin to an upper limit pressure Pmax. The upper limit pressure Pmax and the lower limit pressure Pmin are stored in advance in the nonvolatile memory 182. Note that, the upper limit pressure Pmax and the lower limit pressure Pmin stored in the nonvolatile memory 182 can be changed by operating the operation panel 170.

FIG. 4 is a flowchart for showing an example of the operation number control carried out by the controller 180. The processing of the flowchart of FIG. 4 is started by the operation on the run switch 172*a*, and is repeated at a predetermined sampling cycle Ts (for example, 200 ms) after initial setting is carried out.

In Step S10, the controller 180 acquires the pressure P(t) sensed by the pressure sensor 131 and proceeds to Step S15. In Step S15, the controller 180 determines whether or not the pressure P(t) acquired in Step S10 is lower than the lower limit pressure Pmin. When the pressure P(t) is determined to be lower than the lower limit pressure Pmin in Step S15, the processing proceeds to Step S20. In Step S20, the controller 180 causes all of the compression modules 101A to 101C to start and finishes the processing shown in the flowchart of FIG. 4 in this computation cycle. That is, the controller 180 proceeds to Step S10 in the next computation cycle to be carried out after the sampling cycle Ts elapses.

When the pressure P(t) is determined to be equal to or higher than the lower limit pressure Pmin in Step S15, the processing proceeds to Step S25. In Step S25, the controller 180 determines whether or not the pressure P(t) acquired in Step S10 is equal to or higher than the upper limit pressure Pmax. When the pressure P(t) is determined to be equal to or higher than the upper limit pressure Pmax in Step S25, the processing proceeds to Step S30. In Step S30, the controller 180 stops all of the compression modules 101A to 101C and finishes the processing shown in the flowchart of FIG. 4 in this computation cycle. That is, the controller 180 proceeds to Step S10 in the next computation cycle to be carried out after the sampling cycle Ts elapses.

When the pressure P(t) is determined to be lower than the upper limit pressure Pmax in Step S25, the processing proceeds to Step S35. In Step S35, the controller 180 uses a pressure P(t−1) acquired in Step S10 one computation cycle before and the pressure P(t) acquired in Step S10 in the current computation cycle to compute a pressure change rate K as given by the following expression (1).

$$K = (P(t) - P(t-1))/Ts \tag{1}$$

The pressure change rate K is a temporal change rate of the delivery pressure of the compressor 10.

When the computation processing (Step S35) of the pressure change rate K is completed, the processing proceeds to Step S40. In Step S40, the controller 180 determines whether or not the pressure change rate K computed in Step S35 is a negative value. When the pressure change rate K is determined to be a negative value, that is, the delivery pressure is decreasing in Step S40, the processing proceeds to Step S50. When the pressure change rate K is determined to be not a negative value in Step S40, the processing proceeds to Step S45.

The controller 180 divides a difference between the lower limit pressure Pmin and the current pressure P(t) acquired in Step S10 by the pressure change rate K computed in Step S35 as given by the following expression (2), thereby computing a predicted time Td from the current time to a time at which the lower limit pressure Pmin is reached in Step S50.

$$Td = (P\min - P(t))/K \tag{2}$$

When the computation processing (Step S50) of the predicted time Td is completed, the processing proceeds to Step S60.

In Step S60, the controller 180 determines whether or not the predicted time Td is shorter than a first time threshold value Td1 (for example, 2 seconds) determined in advance. The first time threshold value Td0 is stored in the nonvolatile memory 182. When the predicted time Td is determined to be shorter than the first time threshold value Td0 in Step S60, the processing proceeds to Step S70. When the predicted time Td is determined to be equal to or longer than the first time threshold value Td0 in Step S60, the processing shown in the flowchart of FIG. 4 in this computation cycle is finished.

The controller 180 determines to increase the operation number of the compression modules 101 by one in Step S70 and proceeds to Step S80. In Step S80, the controller 180 causes the compression module 101 having the shortest cumulative operation time and is stopping to start with priority and finishes the processing shown in the flowchart of FIG. 4 in this computation cycle.

In Step S45, the controller 180 determines whether or not the pressure change rate K computed in Step S35 is a positive value. When the pressure change rate K is determined to be a positive value, that is, the delivery pressure is increasing in Step S45, the processing proceeds to Step S55. When the pressure change rate K is determined not to be a positive value in Step S45, that is, the pressure change rate K is 0 and the pressure change does not exist, the processing shown in the flowchart of FIG. 4 in this computation cycle is finished.

In Step S55, the controller 180 divides a difference between the upper limit pressure Pmax and the current pressure P(t) acquired in Step S10 by the pressure change rate K computed in Step S35 as given by the following expression (3), thereby computing a predicted time Tu from the current time to a time at which the upper limit pressure Pmax is reached.

$$Tu = (P\max - P(t))/K \tag{3}$$

When the computation processing (Step S55) of the predicted time Tu is completed, the processing proceeds to Step S65.

In Step S65, the controller 180 determines whether or not the predicted time Tu is shorter than a second time threshold value Tu0 (for example, 5 seconds) determined in advance. The second time threshold value Tu0 is stored in the nonvolatile memory 182. When the predicted time Tu is determined to be shorter than the second time threshold value Tu0 in Step S65, the processing proceeds to Step S75. When the predicted time Tu is determined to be equal to or longer than the second time threshold value Tu0 in Step S65, the processing shown in the flowchart of FIG. 4 in this computation cycle is finished.

The controller 180 determines to reduce the operation number of the compression modules 101 by one in Step S75 and proceeds to Step S85. In Step S85, the controller 180 causes the compression module 101 having the longest cumulative operation time to stop with priority and finishes the processing shown in the flowchart of FIG. 4 in this computation cycle.

As described above, the controller 180 according to the present embodiment controls the operation number of the compression modules 101 on the basis of the pressure P(t) which changes in response to air consumption amount. The controller 180 reduces the operation number of the compression module 101 before the pressure exceeds the upper limit pressure Pmax, thereby reducing wastefully consumed electric power. Moreover, the controller 180 increases the operation number of the compression modules 101 before the pressure falls below the lower limit pressure Pmin, thereby being capable of appropriately supplying a required air amount to the pneumatic device. The controller 180 causes the compression module 101 having a short cumulative operation time to start with priority and causes the compression module 101 having a long cumulative operation time to stop with priority. Thus, the cumulative operation time of each compression module 101 can be equalized. As a result, maintenance of the compression modules 101 is carried out in parallel in the same period, thereby being capable of minimizing a time in which the compressor 10 is not operating.

Note that, a flow of the processing of the operation number control is not limited to the example shown in FIG. 4. The operation number control is only required to be control capable of generating the target pressure by the plurality of compression modules 101 and various modes can be employed as the flow of the processing. For example, the controller 180 may carry out operation number control of repeating processing of simultaneously causing the plurality of compression modules 101 which are target of the operation number control to start when the pressure P(t) sensed by the pressure sensor 131 becomes lower than the lower limit pressure Pmin and processing of simultaneously causing the plurality of compression modules 101 which are the target of the operation number control to stop when the pressure P(t) sensed by the pressure sensor 131 becomes equal to or higher than the upper limit pressure Pmax.

The controller 180 individually determines whether or not each of the plurality of compression modules 101 has an abnormality. When the controller 180 determines that the compression module 101 has an abnormality, the controller 180 sets a stop flag to the compression module 101 determined to have the abnormality. The controller 180 carries out exclusion processing of stopping the compression module 101 to which the stop flag is set and excluding the stopped compression module 101 from the target of the operation number control while continuing the operation number control for the compression modules 101 to which the stop flag is not set. As described above, the controller 180 causes the compression module 101 determined to have the abnormality to stop and excludes the stopped compression module from the target of the operation number control, thereby being capable of preventing subsequent consumption (degradation of the tip seals 111*d* and 112*d*, a damage of the check valve 151, and the like) of the compression module 101. Note that, in the exclusion processing, the controller 180 may stop the compression module 101 to which the stop flag is set and may then exclude this compression module 101 from the target of the operation number control, or may exclude the compression module 101 to which the stop flag is set from the target of the operation number control and may then stop this compression module 101.

Further, the controller 180 causes the display units 171*a* and 171*b* to display information on the compression module 101 to which the stop flag is set. The compression module 101 to which the stop flag is set, that is, the compression module 101 which has stopped due to the setting of the stop flag cannot return to the operation number control unless the stop flag is cleared.

The user can know the stop of the compression module 101 due to sensing of an abnormality or the like and a reason for the stop (for example, a content of the abnormality) in accordance with the display mode of the display units 171*a* and 171*b*. Abnormalities sensed by the controller 180 according to the present embodiment include a temperature abnormality and a current abnormality. Note that, the controller 180 according to the present embodiment sets the stop flag not only when the abnormality is sensed, but also when the cumulative operation time of the compression module 101 reaches a maintenance time. A detailed description is now given of a condition for causing the compression module 101 to stop during the execution of the operation number control (hereinafter also referred to as stop condition).

The controller 180 determines whether or not each of the following first to third stop conditions is satisfied. The controller 180 sets the stop flag when any one of the first to third stop conditions is satisfied, and causes the compression module 101 to which the stop flag is set to stop.

(First stop condition) A temperature difference ΔT between a temperature T1 of the compressor body 110 and an ambient temperature T2 of the compressor 10 is equal to or larger than a temperature threshold value TO. That is, the temperature abnormality is occurring.

(Second stop condition) An overcurrent is sensed by the thermal relay. That is, the current abnormality is occurring.

(Third stop condition) The cumulative operation time has reached the maintenance time.

Note that, as described above, the plurality of stop conditions (first to third stop conditions) include the stop conditions (first and second stop conditions) which are satisfied when the compressor unit 100 is abnormal.

The processing, by the controller 180, of determining whether or not the first stop condition is satisfied is equivalent to processing of determining whether or not the temperature abnormality exists. When aging degradation of the tip seals 111*d* and 112*d* occurs, the compressed gas leaks from the compression chamber 113 through the tip seals 111*d* and 112*d*, is again suctioned into the compression chamber 113, and is compressed, resulting in an increase in the temperature of the compressed air compared with that at the normal time. That is, when the tip seals 111*d* and 112*d* have degraded, and the seal leak occurs, the temperature abnormality is detected by the controller 180.

Note that, a description is given of the example in which whether or not the temperature abnormality is occurring is determined based on the difference between the temperature of the compressor body 110 and the ambient temperature of the compressor 10 in the present embodiment, it may be determined whether or not the temperature abnormality is occurring based on only the temperature of the compressor body 110. However, the temperature of the compressor body 110 is influenced by an environment in which the compressor 10 is installed. For example, when the temperature of a room in which the compressor 10 is installed is high, the temperature of the compressor body 110 is higher than that when the temperature of the room is low. Thus, the temperature abnormality can accurately be detected by determining whether or not the temperature abnormality is occurring based on the difference between the ambient temperature (the temperature in the room) of the compressor 10 and the temperature of the compressor body 110 as in the present embodiment.

Moreover, a description is given of the example in which the temperature sensor 132 is installed in the cooling fin 111*c* in the present embodiment, but the temperature sensor 132 may be installed at a place difference from the cooling fin 111*c* as long as the temperature of a portion which has a certain relation with the temperature inside the compression chamber 113 can be sensed.

The processing, by the controller 180, of determining whether or not the second stop condition is satisfied is equivalent to processing of determining whether or not the current abnormality exists. When the aging degradation of the tip seals 111*d* and 112*d* occurs as described before, the compressed gas may leak from the compression chamber 113 through the tip seals 111*d* and 112*d*, may be again suctioned into the compression chamber 113, and may be compressed. When the compressed gas flows from the compression chamber 113 on a high-pressure side into the compression chamber 113 on a low-pressure side, a force required to drive the compressor body 110 increases. In this case, a motor drive current increases from that at the normal time. That is, when the tip seals 111*d* and 112*d* have degraded and the seal leaks occurs, the current abnormality is detected by the controller 180.

Moreover, the wrap portions 111*b* and 112*b* deform due to aging degradation or the like, the wrap portion 111*b* of the fixed scroll 111 and the wrap portion 112*b* of the orbiting scroll 112 may come in contact with each other. When the wrap portions come in contact with each other, the force required to drive the compressor body 110 becomes large. In this case, the motor drive current increases from that at the normal time. That is, the wrap portions 111*b* and 112*b* degrade and the contact between the wrap portions occurs, the current abnormality is detected by the controller 180.

Moreover, also when aging degradation of the bearings 124A and 124B occurs, the force required to drive the compressor body 110 becomes large and hence the motor drive current increases from that at the normal time. That is, when the bearings 124A and 124B degrade, the current abnormality is detected by the controller 180.

Note that, a description is given of the example in which the current abnormality is detected based on the operation of the thermal relay provided to the electromagnetic switch 140 in the present embodiment, but a current of a power line which connects the electromagnetic switch 140 and the motor 120 to each other may be sensed by a current sensor, and the current abnormality may be detected based on a sensed result thereof. However, when the current sensor is provided, a cost of the compressor 10 increases accordingly. Thus, as in the present embodiment, it is possible to reduce the cost of the compressor 10 by providing the configuration in which the current abnormality is detected based on the operation of the thermal relay of the electromagnetic switch 140.

When the first stop condition is satisfied, the controller 180 sets, as the stop flag, a temperature abnormality stop flag Ft (j) (Ft (j)=1). When the second stop condition is satisfied, the controller 180 sets, as the stop flag, a current abnormality stop flag Fi(j) (Fi(j)=1). When the third stop condition is satisfied, the controller 180 sets, as the stop flag, a maintenance stop flag Fm(j) (Fm(j)=1). Note that, "j" is a number from 1 to 3 for identifying the first to third compression modules 101A to 101C. For example, "j" is 1 for the stop flags associated with the first compression module 101A, "j" is 2 for the stop flags associated with the second compression module 101B, and "j" is 3 for the stop flags associated with the third compression module 101C.

The controller 180 computes the difference ΔT (j) (hereinafter referred to as temperature difference) between the temperature T1(*j*) of the compressor body 110 sensed by the temperature sensor 132 and the temperature T2 of the ambience of the compressor 10 sensed by the ambient temperature sensor 133 (ΔT(j)=T1(*j*)−T2). The controller 180 computes the temperature difference ΔT(j) for each compression module 101. That is, the controller 180 computes, as a temperature difference ΔT(1) of the first compression module 101A, a difference between the temperature T1(1) sensed by the first temperature sensor 132A and the temperature T2 sensed by the ambient temperature sensor 133. Similarly, the controller 180 computes, as a temperature difference ΔT(2) of the second compression module 101B, a difference between the temperature T1(2) sensed by the second temperature sensor 132B and the temperature T2 sensed by the ambient temperature sensor 133. Moreover, the controller 180 computes, as a temperature difference ΔT(3) of the third compression module 101C, a difference between the temperature T1(3) sensed by the third temperature sensor 132C and the temperature T2 sensed by the ambient temperature sensor 133.

The controller 180 determines whether or not the temperature difference ΔT(j) of each compression module 101 is equal to or larger than the temperature threshold value TO. The temperature threshold value TO is stored in advance in the nonvolatile memory 182. The controller 180 determines that the first stop condition is not satisfied when the temperature difference ΔT(j) is smaller than the temperature threshold value TO and hence maintains the temperature abnormality stop flag Ft(j) in the unset state (Ft(j)=0). The controller 180 determines that the first stop condition is satisfied when the temperature difference ΔT is equal to or larger than the temperature threshold value TO and hence sets the temperature abnormality stop flag Ft(j) (Ft(j)=1). The temperature abnormality stop flag Ft(j) is a stop flag which indicates that the temperature abnormality of the compressor unit 100 of the compression module 101 is detected and is set in correspondence to the compression module 101 for which the first stop condition is determined to be satisfied.

The controller 180 determines whether or not an overcurrent is detected by the thermal relay of the electromagnetic switch 140, on the basis of the detection signal of the overcurrent from the thermal relay of the electromagnetic switch 140. The controller 180 determines that the second stop condition is not satisfied when an overcurrent is not detected by the thermal relay, and maintain is the current abnormality stop flag Fi(j) in the unset state (Fi(j)=0). The controller 180 determines that the second stop condition is satisfied when an overcurrent is detected by the thermal relay, and sets the current abnormality stop flag Fi(j) (Fi(j)=1). The current abnormality stop flag Fi(j) is a stop flag which indicates that the overcurrent of the compressor unit 100 of the compression module 101 is detected and is set in correspondence to the compression module 101 for which the second stop condition is determined to be satisfied.

The control device 180 determines whether or not the cumulative operation time to has reached the maintenance time to0. The maintenance time to0 is stored in advance in the nonvolatile memory 182. The controller 180 determines that the third stop condition is not satisfied when the cumulative operation time to is shorter than the maintenance time to0, and maintains the maintenance stop flag Fm(j) in the unset state (Fm(j)=0). The controller 180 determines that the third stop condition is satisfied when the cumulative operation time to is equal to or longer than the maintenance time to0, and sets the maintenance stop flag Fm(j) (Fm(j)=1). The maintenance stop flag Fm(j) is a stop flag which indicates that the maintenance time is reached and is set in correspondence to the compression module 101 for which the third stop condition is determined to be satisfied.

As described above, the compression module 101 to which the stop flag is set is not included into the operation number control unless the setting of the stop flag is cleared. The controller 180 carries out the test operation of the stopped compression module 101 on the basis of an operation command from the operation panel 170. When the user confirms, by the test operation, that the abnormality does not exist, the user carries out an operation of clearing the stop flag. As a result, the setting of the stop flag is cleared and the compression module 101 which has finished the test operation can be returned to the operation number control.

The controller 180 according to the present embodiment carries out the test operation processing of causing the compression module 101 to which the stop flag is set to restart and causing the restarted compression module 101 to operate for the predetermined time while continuing the operation number control for the compression modules 101 to which the stop flag is not set. That is, the controller 180 causes, while continuing the operation number control for the compression modules 101 that are the target of the operation number control, the compression module 101 excluded from the target of the operation number control to start. For example, the controller 180 causes the compression module 101 determined to have the temperature abnormality to restart while continuing the operation number control for the compression modules 101 determined not to have the temperature abnormality.

Note that, the controller 180 disables the clearing of the setting of the stop flag when the test operation processing has not been completed after carrying out the exclusion processing, and enables the clearing of the setting of the stop flag when the test operation processing has been completed after carrying out the exclusion processing.

Figure 5:
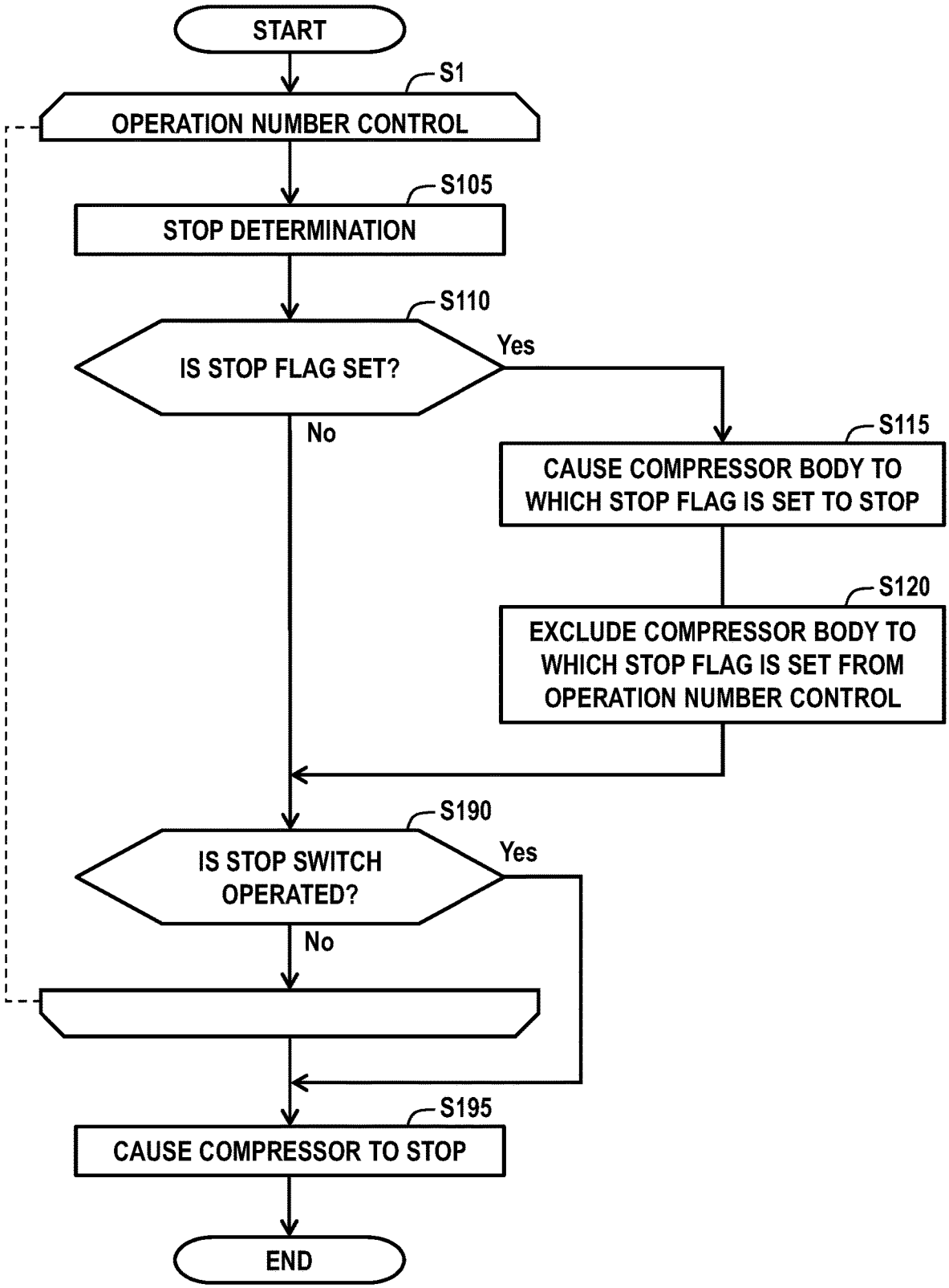
FIG. 5 is a flowchart for showing a content of control for causing a compression module to stop when a stop condition is satisfied during the operation number control.

With reference to FIG. 5, a detailed description is now given of a content of the control of causing the compression module 101 to stop when the stop condition is satisfied during the operation number control. As described before, when the run switch 172*a* is operated, the operation number control (Step S1 of FIG. 5 and the flowchart of FIG. 4) is carried out by the controller 180. As illustrated in FIG. 5, the controller 180 repeats processing in Steps S105 to S190 at a predetermined sampling cycle during the execution of the operation number control (Step S1).

In Step S105, the controller 180 carries out processing of determining whether or not the first to third stop conditions are satisfied. When the control device 180 determines that the stop condition is satisfied, the controller 180 sets the stop flag in correspondence to the compression module 101 for which the stop condition is determined to be satisfied. For example, when the controller 180 determines that the first stop condition is satisfied for the first compression module 101A, the controller 180 switches the temperature abnormality stop flag Ft(1) of the first compression module 101A from unset state (OFF) to the set state (ON) (Ft(1)=0→Ft(1)=1). Moreover, for example, when the controller 180 determines that the second stop condition is satisfied for the second compression module 101B, the controller 180 switches the current abnormality stop flag Fi(2) of the second compression module 101B from unset state (OFF) to the set state (ON) (Fi(2)=0→Fi(2)=1). Further, for example, when the controller 180 determines that the third stop condition is satisfied for the third compression module 101C, the controller 180 switches the maintenance stop flag Fm(3) of the third compression module 101C from unset state (OFF) to the set state (ON) (Fm(3)=0→Fm(3)=1).

When the stop determination processing (Step S105) is completed, the processing proceeds to Step S110. In Step S110, the controller 180 determines whether or not the stop flag is set to at least one of the plurality of compression modules 101. When it is determined that the stop flag is set to none of the plurality of compression modules 101 in Step S110, the processing proceeds to Step S190. When it is determined that the stop flag is set to at least one of the plurality of compression modules 101 in Step S110, the processing proceeds to Step S115.

In Step S115, the controller 180 carries out the stop processing of causing the compression module 101 to which the stop flag is set to stop and proceeds to Step S120.

In Step S120, the controller 180 carries out the exclusion processing of excluding the compression module 101 to which the stop flag is set from the operation number control and proceeds to Step S190.

In Step S190, the controller 180 determines whether or not the stop switch 172*b* is operated. When it is determined that the stop switch 172*b* is not operated in Step S190, the procession returns to Step S105. When it is determined that the stop switch 172*b* is operated in Step S190, the procession proceeds to Step S195. In Step S195, the controller 180 stops all compression modules 101 and finishes the processing shown in the flowchart of FIG. 5.

Figure 6:
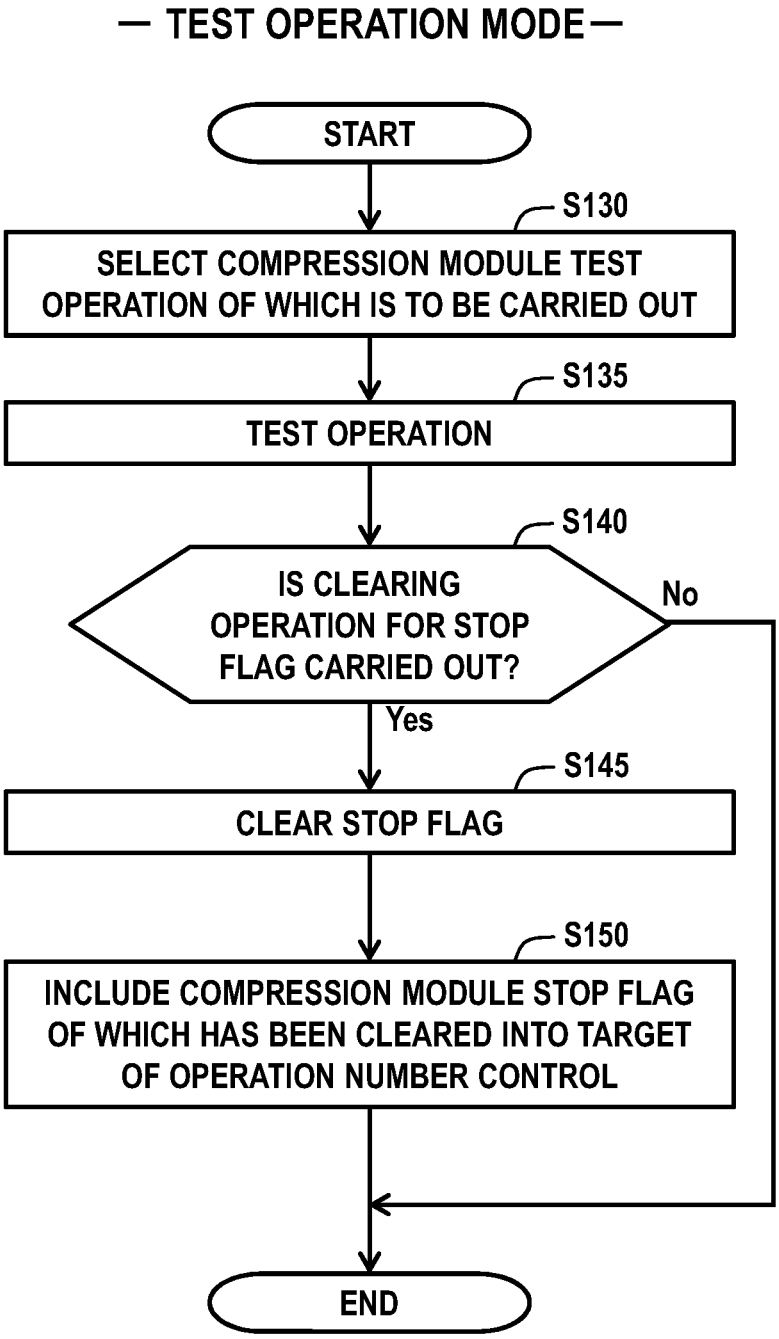
FIG. 6 is a flowchart for showing a content of a test operation for the compression module carried out during the operation number control and control for returning the compression module to the operation number control.

With reference to FIG. 6, a detailed description is now given of a content of control which is carried out, during the operation number control, for the test operation of the compression module 101 and for the return of the compression module 101 to the operation number control. When an operation for starting the test operation is carried out by the operation panel 170, the controller 180 sets a test operation mode. Processing shown in FIG. 6 is carried out as a result of the set of the test operation mode. As shown in FIG. 6, when the test operation mode is set, the controller 180 causes, in Step S130, the display unit 171*a* to display a selection operation screen which prompts the user to perform a selection operation for the compression module 101 the test operation of which is to be carried out. The selection operation screen is, for example, a screen which displays the number (for example, one of 1 to 3) of the compression module 101 the test operation of which is to be carried out. Each time the display changeover switch 172*d* is operated, the number of the compression module 101 in the display unit 171*a* is switched. When the menu switch 172 is operated while the number representing the compression module 101 the test operation of which is to be carried out is being displayed, the controller 180 selects the compression module 101 corresponding to the number displayed on the test operation body selection screen, as the compression module the test operation of which is to be carried out. Note that, it is not possible to carry out the test operation of the compression module 101 which is not stopped.

When the compression module 101 the test operation of which is to be carried out is selected in Step S130, the processing proceeds to Step S135. In Step S135, the controller 180 carries out the test operation processing of operating the motor 120 at a constant speed for a predetermined time tp by supplying the electric power by the electromagnetic switch 140 to the motor 120 of the compression module 101 selected in Step S130. The predetermined time tp is only required to be a time long enough for checking the abnormality of the compression module 101 and a value approximately from some seconds to some minutes is set. It is preferred that the predetermined time tp be set to approximately some seconds in initial setting and the predetermined time tp be allowed to be changed by the operation panel 170. Further consumption (degradation) of the compression module 101 can be suppressed by setting the time for the test operation to approximately some seconds. Moreover, it is possible to change the predetermined time tp to a time longer than that at the initial setting by allowing the change in the predetermined time tp through the operation panel 170 depending on necessity, thereby being capable of increasing accuracy of the check of the abnormality.

Note that, in Step S135, the controller 180 may stop, for the predetermined time tp, the compression module 101 in operation by the operation number control in order to suppress a change in a flow rate of the gas delivered from the compressor 10. For example, when two of the first compression module 101A and the second compression module 101B are in operation, and the test operation of the third compression module 101C to which the stop flag is set is being carried out, the controller 180 may cause the third compression module 101C to start and cause the first compression module 101A or the second compression module 101B to stop to operate.

When the test operation processing (Step S135) is completed, the processing proceeds to Step S140. In Step S140, the controller 180 causes the display unit 171*a* to display a flag clearing selection screen. The flag clearing selection screen is, for example, a screen which prompts the user to carry out an operation of selecting whether or not the stop flag is to be cleared. Each time the display changeover switch 172*d* is operated, the display of "y" and "n" is switched as a selection content displayed on the flag clearing selection screen.

In Step S140, the controller 180 determines whether or not the operation for clearing the stop flag is carried out. When the menu switch 172*c* is operated when "y" is displayed on the display unit 171*a*, the controller 180 determines that the operation for clearing the stop flag is carried out in Step S140, and proceeds to Step S145. When the menu switch 172*c* is operated when "n" is displayed on the display unit 171*a* in Step S140, the controller 180 finishes the test operation mode without clearing the stop flag of the compression module 101 the test operation of which has been carried out. Note that, the operation method for clearing the stop flag is not limited to this example.

In Step S145, the controller 180 clears the setting of the stop flag of the compression module 101 the test operation of which has been carried out and proceeds to Step S150. In Step S150, the controller 180 includes the compression module 101 the setting of the stop flag of which has been cleared in Step S145 into the operation number control and finishes the test operation mode. The compression modules 101 to which the stop flag is not set are continuing the operation-number-control operation during the test operation of the compression module 101 to which the stop flag is set. That is, in Step S150, the compression module 101 the setting of the stop flag of which has been cleared is to return to the operation-number-control operation.

According to the embodiment described above, the following operational advantages are provided.

(1) The compressor 10 is provided with the compressor units 100 each including the compressor body 110 which compresses the gas and the motor 120 which drives the compressor body 110 and the controller 180 which carries out the operation number control for the plurality of compressor units 100. The plurality of compressor units 100 are connected to the same pipe (main delivery pipe 105). The controller 180 causes, while continuing the operation number control for the compressor units 100 that are the target of the operation number control, the compressor unit 100 excluded from the target of the operation number control to start.

With this configuration, when a predetermined compressor unit 100 (for example, the third compressor unit 100C) stops due to the abnormality detection of the like, the predetermined compressor unit (for example, the third compressor unit 100C) can be caused to start, can be caused to operate for the test without interfering the operation-number-control operation of other compressor units (for example, the first and second compressor units 100A and 100B), and can then be included into the operation-number-control operation after the predetermined compressor unit 100 is confirmed to be normal. When the test operation of the predetermined compressor unit 100 is to be carried out, the operation-number-control operation for the other compressor units 100 is not interfered and hence the operating rate of the compressor 10 can be increased.

(2) The controller 180 determines whether or not the plurality of compressor units 100 have an abnormality. The controller 180 causes the compressor unit 100 determined to have the abnormality to stop, and excludes this compressor unit 100 from the target of the operation number control, and causes the compressor unit 100 determined to have the abnormality to restart while continuing the operation number control for the compressor units 100 determined not to have an abnormality.

With this configuration, the compressor unit 100 determined to have an abnormality can be caused to restart, can be caused to operate for the test without interfering the operation-number-control operation for the compressor units 100 determined not to have an abnormality, and can then be included into the operation-number-control operation after this compressor unit 100 is confirmed to be normal. Thus, the compressor unit 100 determined to have the abnormality due to erroneous detection can quickly be returned to the operation number control. For example, the ambient temperature T2 may quickly decrease when a door of a room in which the compressor 10 is installed is opened and hence external air flows into the room. A degree of decrease in the temperature T1(*j*) of the compressor body 110 on this occasion is lower than a degree of decrease in the ambient temperature T2. That is, an absolute value of a temporal change rate of the temperature T1(*j*) of the compressor body 110 is smaller than an absolute value of a temporal change rate of the ambient temperature T2. As a result, there is such a case that the temperature difference ΔT becomes the temperature threshold value TO or more and hence the temperature abnormality is determined to exist.

As described above, even when the leak is not occurring at the tip seals 111*d* and 112*d* of the compressor body 110, an erroneous detection of the temperature abnormality may be made. When the entire compressor 10 is stopped in such a case, the operating rate of the compressor 10 decreases. Thus, the user carries out the test operation to determine whether or not the temperature abnormality is erroneously detected. The user determines whether or not the temperature abnormality is erroneously detected by using a preliminary thermometer to measure the temperature of the compressor body 110 or causing the sensed value of the permanent temperature sensor 132 to be displayed on the display unit 171*a*.

When the user determines that the temperature abnormality is erroneously detected, the user carries out the clearing operation for the stop flag (temperature abnormality stop flag) to clear the stop flag. As a result, the compressor unit 100 stopped due to the erroneous detection can quickly be returned to the operation number control. Moreover, the other compressor units 100 are continuing the operation-number-control operation while the series of the control such as the processing of causing the predetermined compressor unit 100 to stop due to the erroneous detection, the processing of carrying out the test operation of this compressor unit 100, and the processing of returning this compressor unit 100 to the operation number control is being carried out. Thus, a decrease in the operating rate of the compressor 10 can be suppressed to the minimum. That is, according to the present embodiment, compared with a case in which the entire compressor 10 is stopped for the test operation and the test operation is then carried out, the decrease in the operating rate of the compressor 10 can be suppressed.

(3) Note that, for the current abnormality, leak of the compressed gas caused by the degradation of the tip seals 111*d* and 112*d* of the compressor body 110, the contact between the wrap portions 111*b* and 112*b* due to the deformations of the wrap portions 111*b* and 112*b*, and the degradation of the bearings 124A and 124B can be considered as causes. Thus, the user carries out the test operation, thereby checking the cause of the current abnormality. The user checks presence or absence of noise caused by the contact between the wrap portions and noise of the bearings 124A and 124B by ear. Moreover, the user measures the temperature of the compressor body 110 by a preliminary thermometer or causes the display unit 171*a* to display the sensed value of the permanent temperature sensor 132. The user can identify the cause of the current abnormality on the basis of the sound during the test operation of the compressor unit 100 and the temperature of the compressor body 110. After that, the user stops the compressor 10 and carries out maintenance work for eliminating the cause of the current abnormality. In this way, in the present embodiment, the operation number control for the other compressor units 100 can be continued during the test operation for identifying the cause of the current abnormality of the predetermined compressor unit 100 and hence the operating rate of the compressor 10 can be increased.

(4) When the controller 180 determines that the compressor unit 100 has an abnormality, the controller 180 sets the stop flag to the compressor unit 100 determined to have the abnormality. The controller 180 carries out the exclusion processing of stopping the compressor unit 100 to which the stop flag is set and excluding the stopped compressor unit 100 from the target of the operation number control while continuing the operation number control for the compressor units 100 to which the stop flag is not set. The controller 180 carries out the test operation processing of causing the compressor unit 100 to which the stop flag is set to restart while continuing the operation number control for the compressor units 100 to which the stop flag is not set. The controller 180 disables the clearing of the setting of the stop flag when the test operation processing has not been completed after carrying out the exclusion processing, and enables the clearing of the setting of the stop flag when the test operation processing has been completed after carrying out the exclusion processing.

When the clearing of the setting of the stop flag is enabled without completing the test operation processing of the predetermined compressor unit 100, the following problem is considered to occur. When the temperature abnormality caused by the leak at the tip seals 111*d* and 112*d* actually occurs and hence the compressor unit 100 stops, an operation of clearing the setting of the stop flag may be carried out by the user by mistake. In this case, further degradation of the tip seals 111*d* and 112*d* may be induced. Meanwhile, in the present embodiment, the setting of the stop flag cannot be cleared unless the test operation processing is finished. Thus, the problem described above does not occur. That is, the user can carry out the test operation, and determine whether or not the temperature abnormality is erroneously detected. When the temperature abnormality is not erroneously detected, the user can stop the compressor 10, and can take an appropriate response such as replacement of the tip seals 111*d* and 112*d* of the compressor unit 100 and the like.

(5) The controller 180 includes, when the setting of the stop flag of the compressor unit 100 that is not the target of the operation number control is cleared while the operation number control for the compressor units 100 that are the target of the operation number control is being carried out, the compressor unit 100 the setting of the stop flag of which is cleared into the target of the operation number control while continuing the operation number control. With this configuration, it is possible to return the compressor unit 100 the test operation of which has been completed to the operation number control without causing the compressor 10 to stop. Thus, according to the present embodiment, the operating rate of the compressor 10 can be increased compared with a case in which the compressor 10 is caused to stop when the compressor unit 100 is returned to the operation number control.

(6) The compressor 10 includes the electromagnetic switches 140 each of which switches between the supply and the interruption of the electric power to the motor 120. The controller 180 supplies the electric power to the motor 120 by the electromagnetic switch 140, thereby causing the compressor unit 100 which is not the target of the operation number control to operate at a constant speed for the predetermined time tp and then causing this compressor unit 100 to stop. With this configuration, the operation time of the test operation is limited to the predetermined time tp. That is, the test operation is prevented from continuously being carried out for a time longer than the predetermined time tp. Thus, it is possible to prevent the compression module 101 from being damaged by the test operation being carried out for a long time.

Modification Example of First Embodiment

In the first embodiment, a description is given of the example in which the number of the compressor units 100 is three, the number of the compressor units 100 which are not the target of the operation number control is one, the test operation of this compressor unit 100 is carried out, and this compressor unit 100 is returned to the operation number control after the stop flag is cleared, but the present invention is not limited to this example. For example, the present invention may be applied to the compressor 10 which is provided with four or more compressor units 100 or the compressor 10 which is provided with only two compressor units 100. Note that, in the case of the compressor 10 provided with only two compressor units 100, when one of the two compressor units 100 is stopped due to the stop flag, only one compressor unit 100 capable of normally operating remains. In this case, the remaining one compressor unit 100 is not caused to additionally start by the processing in Steps S70 and S80, but the flow of the processing of the operation number control shown in FIG. 4 itself is the same. That is, in the compressor 100 provided with two or more compressor units 100, the controller 180 carries out the operation number control shown in FIG. 4 regardless of the number of stopping compressor units 100.

Moreover, when a plurality of compressor units 100 excluded from the target of the operation number control exist, the test operation of the compressor units 100 excluded from the target of the operation number control may be carried out and may be returned to the operation number control after the stop flag is cleared. Note that, when there exist the plurality of compressor units 100 excluded from the target of the operation number control, it is preferred that the test operation be carried out for one compressor unit 100 at a time. When the test operation of the plurality of compressor units 100 carried out simultaneously, there is a case in which the check of the presence or absence of an abnormality is difficult.

Figure 7:
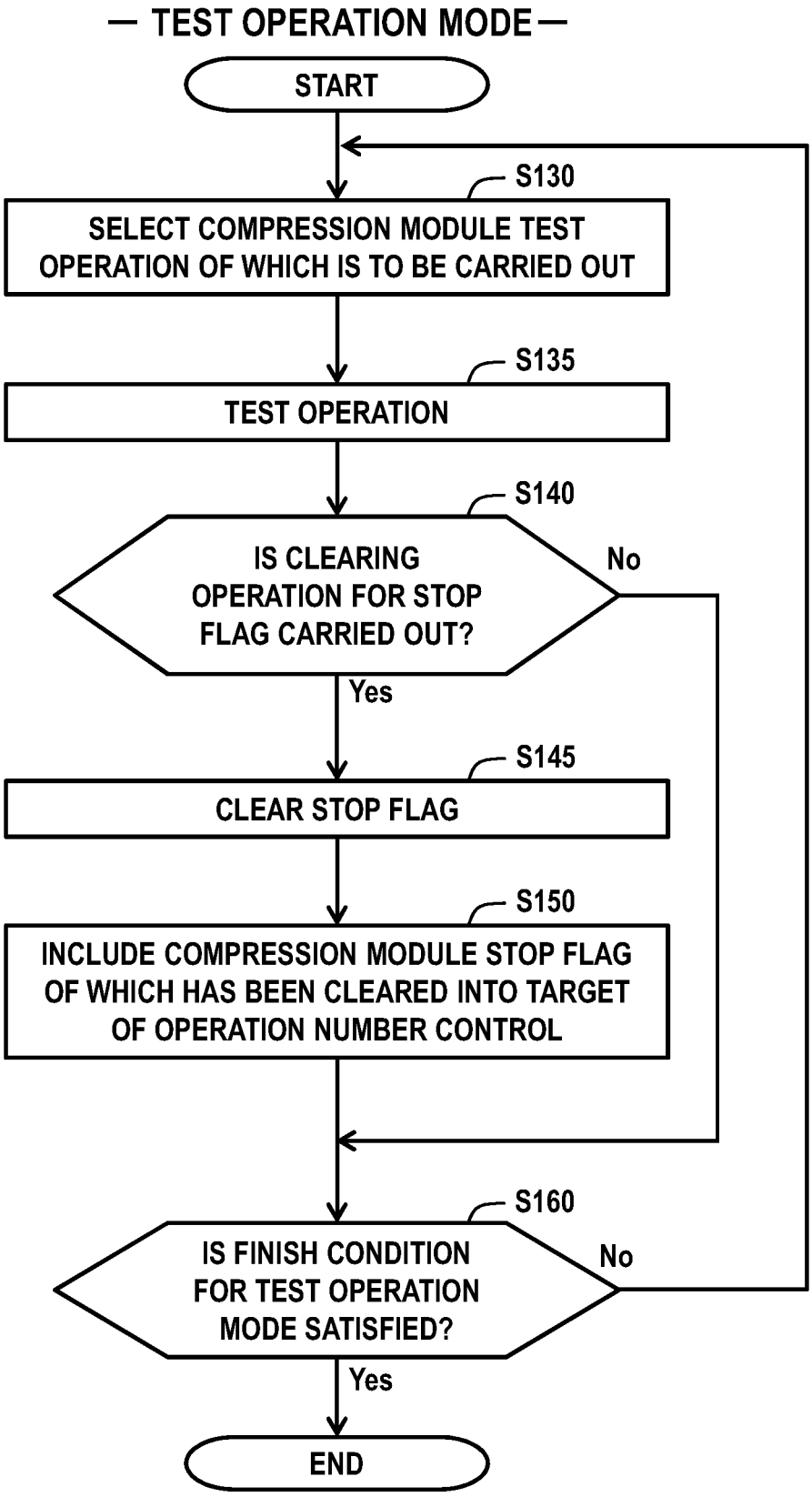
FIG. 7 is a flowchart for showing a content of control at the time when a test operation mode is set by the controller according to a modification example of the first embodiment.

FIG. 7 is a drawing similar to FIG. 6 and is a flowchart for showing a content of control when the test operation mode is set by the controller 180 according to the modification example of the first embodiment. In the flowchart of FIG. 7, processing in Step S160 is added after the processing of Step S150 of the flowchart of FIG. 6. As shown in FIG. 7, when the processing of including the compression modules 101 the stop flag of which is cleared into the target of the operation number control is completed in Step S150, the processing proceeds to Step S160.

In Step S160, the controller 180 determines whether or not a finish condition for the test operation mode is satisfied. When the compression module 101 to which the stop flag is set exists in the plurality of compression modules 101, the controller 180 determines that the finish condition for the test operation mode is not satisfied and returns to Step S130. When the compression module 101 to which the stop flag is set does not exist in the plurality of compression modules 101, the controller 180 determines that the finish condition for the test operation mode is satisfied and finishes the processing shown in the flowchart of FIG. 7. Note that, in Step S130, the controller 180 selects only one compression module 101 to which the stop flag is set and proceeds to Step S135.

As described above, in the present modification example, when there exist a plurality of compressor units 100 excluded from the target of the operation number control, the controller 180 drives, one at a time, the plurality of compressor units 100 excluded from the target of the operation number control. Thus, when there exist a plurality of compressor units 100 to which the stop flag is set, the user selects the compressor units 100 the test operation of which is to be carried out one at a time and carries out the test operation one at a time. As a result, for example, it is possible to appropriately check the presence or absence of an abnormality of the compressor unit 100 on the basis of the sound of the compressor unit 100 in the test operation.

Second Embodiment

Figure 8:
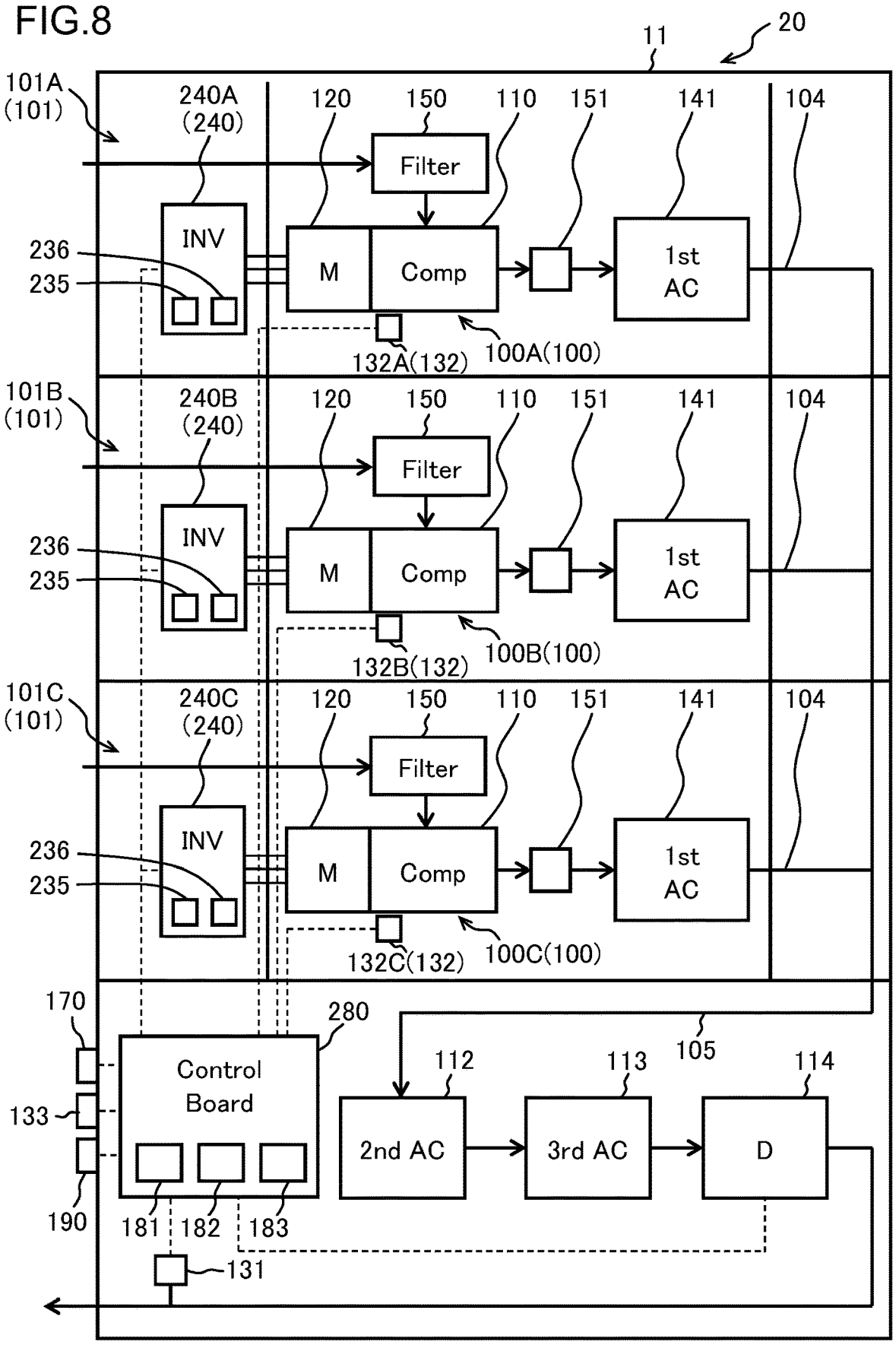
FIG. 8 is a diagram for showing the configuration of a compressor according to a second embodiment.
Figure 9:
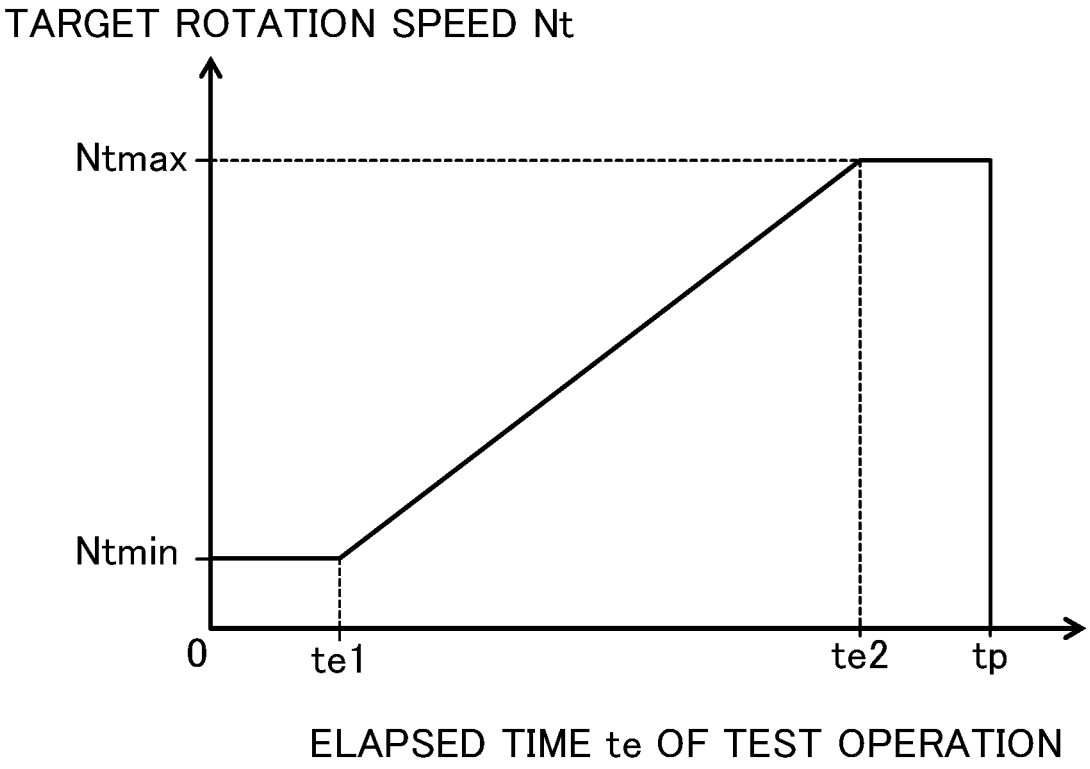
FIG. 9 is a graph for showing a target rotation speed table used for speed control for a motor by the controller according to a modification example of the second embodiment.

With reference to FIG. 8 and FIG. 9, a description is now given of a compressor 20 according to a second embodiment of the present invention. Note that, a configuration the same as or corresponding to the configuration described in the first embodiment is assigned with the same reference symbol and a description is mainly given of different points. FIG. 8 is a drawing similar to FIG. 1 and is a diagram for showing a configuration of the compressor 20 according to the second embodiment.

The compressor 10 according to the first embodiment is configured such that each of the motors 120 is controlled to rotate at the constant speed by each of the electromagnetic switches 140 (see FIG. 1). Meanwhile, the compressor 20 according to the second embodiment is configured such that the rotation speed of each of motors 120 is controlled by each of inverters 240 as shown in FIG. 8. A detailed description is now given of the compressor 20 according to the second embodiment.

The compressor 20 according to the second embodiment is configured substantially similarly to the first embodiment, but the inverters 240 which supply the electric power from the power supply to the motors 120 are provided in place of the electromagnetic switches 140 described in the first embodiment. Note that, an inverter 240A of the first compression module 101A, an inverter 240B of the second compression module 101B, and an inverter 240C of the third compression module 101C have similar configurations to each other.

A controller 280 controls the rotation speed of the motors 120 by the inverters 240 such that the delivery pressure (that is, the pressure sensed by the pressure sensor 131) changing according to the consumption amount of the compressed gas maintains a pressure target value determined in advance. The controller 280 according to the present embodiment converts a current frequency (for example, 60 Hz) of a commercial power supply to a target current frequency on the basis of the sensing result of the pressure sensor 131 and supplies the target current frequency to the motor 120, thereby controlling the rotation speed of the motor 120.

The inverter 240 includes a plurality of switching elements, a voltage sensor 235, and a current sensor 236. The inverter 240 has a well-known configuration including a converter circuit, an inverter circuit, and a smoothing capacitor. The inverter circuit inverts a DC current supplied from the converter circuit to an AC current by the switching elements. The voltage sensor 235 senses a DC voltage between a pair of power lines (DC buses) which connect the converter circuit and the inverter circuit to each other and outputs a voltage signal representing a sensing result thereof to the controller 280. The current sensor 236 is provided to an electrically conductive member which connects the inverter circuit and an armature winding in each phase of the motor (three-phase AC motor) 120, senses a current supplied to the motor 120, and outputs a current signal representing a sensing result thereof to the controller 280.

In the first embodiment, the compressor units 100 are operated at the constant speed and hence a delivery flow rate is maintained constant regardless of the consumption amount of the compressed gas. Meanwhile, in the second embodiment, the motor rotation speeds are controlled by the inverters 240 according to the consumption amount of the compressed gas, thereby being capable of achieving an operation of a volume control type which adjusts the delivery flow rate (output) and an operation of a fixed control type which provides a constant delivery flow rate (output) regardless of the consumption amount of the compressed air. For example, the delivery pressure (tank pressure) may be always maintained in a vicinity of a lower limit pressure by controlling the rotation speed of the motors 120 regardless of the start and stop of the compressor units 100 in a state in which fluctuation of the gas consumption amount is low in the operation-number-control operation. As a result, it is possible to avoid an operation in a high-pressure range and hence the consumed electric power can be suppressed.

The controller 280 determines whether or not the following first to fifth stop conditions are satisfied. The controller 280 sets the stop flag when any one of the first to fifth stop conditions is satisfied and causes the compression module 101 to which the stop flag is set to stop.

(First stop condition) The temperature difference $\Delta T$ between the temperature T1 of the compressor body 110 and the ambient temperature T2 of the compressor 20 is equal to or larger than the temperature threshold value TO. That is, the temperature abnormality is occurring.

(Second stop condition) A current I sensed by the current sensor 236 is equal to or larger than a current threshold value I0. That is, the current abnormality is occurring.

(Third stop condition) The cumulative operation time has reached the maintenance time.

(Fourth stop condition) A voltage V sensed by the voltage sensor 235 is equal to or higher than a high-voltage threshold value VH. That is, a high-voltage abnormality is occurring.

(Fifth stop condition) The voltage V sensed by the voltage sensor 235 is lower than a low-voltage threshold value VL. That is, a low-voltage abnormality is occurring.

The first stop condition and the third stop condition of the second embodiment are similar to the first stop condition and the third stop condition of the first embodiment and hence a description thereof is omitted. The second stop condition of the second embodiment is in common with that of the first embodiment in such a point that the occurrence of the current abnormality is set to the stop condition, but an overcurrent is detected on the basis of the current I sensed by the current sensor 236 of the inverter 240 in the second embodiment. Note that, causes of the occurrences of the temperature abnormality and the current abnormality are similar to those in the first embodiment and hence a description thereof is omitted.

The processing, by the controller 280, of determining whether or not the fourth stop condition is satisfied is equivalent to processing of determining whether or not the high-voltage abnormality exists. When aging degradation of the check valve 151 of a predetermined compression module 101 occurs, the compressed gas may flow back from the main delivery pipe 105 side to the compressor body 110 of the predetermined compression module 101. When the predetermined compression module 101 is stopped and the compressed gas flows back to the compressor body 110 of this compression module 101, the compressor body 110 is rotated, and the motor 120 rotates. As a result, the motor 120 generates electricity and the voltage V sensed by the voltage sensor 235 becomes higher than that at the normal time. That is, when the check valve 151 is degraded and the backflow to the compressor body 110 occurs, the high-voltage abnormality is detected by the controller 280.

The processing, by the controller 280, of determining whether or not the fifth stop condition is satisfied is equivalent to processing of determining whether or not the low-voltage abnormality exists. When the aging degradation of the check valve 151 of a predetermined compression module 101 occurs and leak of the compressed gas occurs, step-out may occur when the compressor unit 100 thereof is caused to drive. As a result, the voltage V sensed by the voltage sensor 235 becomes lower than that at the normal time. That is, when the check valve 151 is degraded and the step-out of the compressor unit 100 occurs, the low-voltage abnormality is detected by the controller 280.

When the first stop condition is satisfied, the controller 280 sets, as the stop flag, the temperature abnormality stop flag Ft(j) (Ft(j)=1). When the second stop condition is satisfied, the controller 280 sets, as the stop flag, the current abnormality stop flag Fi(j) (Fi(j)=1). When the third stop condition is satisfied, the controller 280 sets, as the stop flag, the maintenance stop flag Fm(j) (Fm(j)=1). When the fourth stop condition is satisfied, the controller 280 sets, as the stop flag, a high-voltage abnormality stop flag Fvh(j) (vh(j)=1). When the fifth stop condition is satisfied, the controller 280 sets, as the stop flag, a low-voltage abnormality stop flag Fvl(j) (Fvl(j)=1).

The controller 280 determines whether or not a current I (j) sensed by the current sensor 236 is equal to or higher than the current threshold value I0. The current threshold value I0 is stored in the nonvolatile memory 182 in advance. The controller 280 determines that the second stop condition is not satisfied when the current I(j) is smaller than the current threshold value I0 and hence maintains the current abnormality stop flag Fi(j) in the unset state (Fi(j)=0). The controller 280 determines that the second stop condition is satisfied when the current I (j) is equal to or larger than the current threshold value I0 and hence sets the current abnormality stop flag Fi(j) (Fi(j)=1). The current abnormality stop flag Fi(j) is a stop flag which indicates that the current abnormality of the compressor unit 100 of the compression module 101 is detected and is set in correspondence to the compression module 101 for which the second stop condition is determined to be satisfied.

The controller 280 determines whether or not a voltage V (j) sensed by the voltage sensor 235 is equal to or higher than the high-voltage threshold value VH. The high-voltage threshold value VH is stored in the nonvolatile memory 182 in advance. The controller 280 determines that the fourth stop condition is not satisfied when the voltage V(j) is lower than the high-voltage threshold value VH and hence maintains the high-voltage abnormality stop flag Fvh(j) in an unset state (Fvh(j)=0). The controller 280 determines that the fourth stop condition is satisfied when the voltage V(j) is equal to or higher than the high-voltage threshold value VH and hence sets the high-voltage abnormality stop flag Fvh(j) (Fvh(j)=1). The high-voltage abnormality stop flag Fvh(j) is a stop flag which indicates that the high-voltage abnormality of the compressor unit 100 of the compression module 101 is detected and is set in correspondence to the compression module 101 for which the fourth stop condition is determined to be satisfied.

The controller 280 determines whether or not the voltage V(j) sensed by the voltage sensor 235 is lower than the low-voltage threshold value VL. The low-voltage threshold value VL is a threshold value lower than the high-voltage threshold value VH and is stored in the nonvolatile memory 182 in advance. The controller 280 determines that the fifth stop condition is not satisfied when the voltage V(j) is equal to or higher than the low-voltage threshold value VL and hence maintains the low-voltage abnormality stop flag Fvl(j) in an unset state (Fvl(j)=0). The controller 280 determines that the fourth stop condition is satisfied when the voltage V(j) is lower than the low-voltage threshold value VL and hence sets the low-voltage abnormality stop flag Fvl(j) (Fvl(j)=1). The low-voltage abnormality stop flag Fvl(j) is a stop flag which indicates that the low-voltage abnormality of the compressor unit 100 of the compression module 101 is detected and is set in correspondence to the compression module 101 for which the fifth stop condition is determined to be satisfied.

The controller 280 according to the second embodiment carries out processing similar to the processing shown in FIG. 5 and FIG. 6 described in the first embodiment. Note that, in the second embodiment, in Step S105 shown in FIG. 5, the controller 280 carries out processing of determining whether or not the first to fifth stop conditions are satisfied. When the control device 280 determines that the stop condition is satisfied, the controller 180 sets the stop flag in correspondence to the compression module 101 for which the stop condition is determined to be satisfied.

In Step S135 shown in FIG. 6, the controller 280 carries out the test operation processing of causing the compression module 101 selected in Step S130 to operate for the predetermined time tp. In the second embodiment, the controller 280 causes the motor 120 to rotate at the lowest speed Ntmin in the test operation processing. Note that, the lowest speed Ntmin is the lowest value within a speed control range of the motor 120. The lowest speed Ntmin is also considered as the lowest value of the speed at which the compressor unit 100 can stably be rotated.

As described above, the controller 280 according to the second embodiment causes the motor 120 of the compressor unit 100 excluded from the target of the operation number control to operate at the lowest speed for the predetermined time and then causes the motor 120 to stop. In the case in which the current abnormality of the compressor unit 100 is detected due to the contact between the wrap portions 111*b* and 112*b* and hence this compressor unit 100 is stopped, when the test operation is carried out at the highest speed in the speed control range of the motor 120, the wrap portions 111*b* and 112*b* may be damaged. Meanwhile, in the second embodiment, the motor 120 is operated at the lowest speed and hence it is possible to prevent the damage of the compression module 101. That is, according to the second embodiment, it is possible to determine whether or not the motor 120 is normal by the test operation while preventing the damage of the compression module 101.

Modification Example of Second Embodiment

The controller 280 may gradually increase the rotation speed of the motor 120 of the compressor unit 100 excluded from the operation number control from the lowest speed Ntmin to a predetermined speed (for example, the highest speed Ntmax) as the time elapses. In the nonvolatile memory 182 is stored a target rotation speed table (see FIG. 9) which is a table for defining a relation between an elapsed time te of the test operation and a target rotation speed Nt. As shown in FIG. 9, the target rotation speed Nt is the lowest speed Ntmin when the elapsed time te of the test operations is from 0 to te1. When the elapsed time te of the test operation exceeds te1, the target rotation speed Nt becomes higher as the elapsed time te becomes longer, and when the elapsed time te of the test operation reaches te2, the target rotation speed Nt reaches the maximum speed Ntmax. When the elapsed time te of the test operation exceeds te2, the target rotation speed Nt is maintained at the maximum speed Ntmax and when the elapsed time te of the test operation reaches the predetermined time tp, the target rotation speed Nt becomes 0.

When the controller 280 starts the test operation processing (Step S135 of FIG. 6), the controller 280 starts to measure the elapsed time te of the test operation. The controller 280 is configured to refer to the target rotation speed table shown in FIG. 9 to compute the target rotation speed Nt corresponding to the elapsed time te. The controller 280 outputs, to the inverter 240, a control signal for causing the motor 120 to rotate at the target rotation speed Nt.

As a result, the rotation speed of the motor 120 gradually increases as the time elapses. According to such a modification example, it is possible to check the presence or absence of an abnormality corresponding to a specific rotation speed.

For example, in the case in which the tip seals 111*d* and 112*d* are degraded, even when the rotation speed of the motor 120 is low, the compressed gas at a high temperature leaks through the tip seals 111*d* and 112*d* and is further compressed, resulting in an increase in temperature of the compressor body 110. Note that, when the test operation is carried out at a low speed, the rotation speed of the cooling fan 130 is also low and hence the temperature of the compressor body 110 tends to increase. Thus, the user can check the presence or absence of the degradation of the tip seals 111*d* and 112*d* by measuring the temperature of the compressor body 110 in the state in which the test operation is being carried out at the low speed.

Moreover, deformation amounts of the warp portions 111*b* and 112*b* increase due to a centrifugal force by increasing the rotation speed of the motor 120. Thus, the user can check the presence or absence of the contact between the wrap portions 111*b* and 112*b* by hearing the sound generated from the compressor unit 100 or measuring the motor drive current while the rotation speed of the motor 120 is gradually increasing.

As described above, in the present modification example, the presence or absence of the specific abnormality corresponding to the rotation speed can be checked and hence the cause of the abnormality can easily be identified.

Third Embodiment

Figure 10:
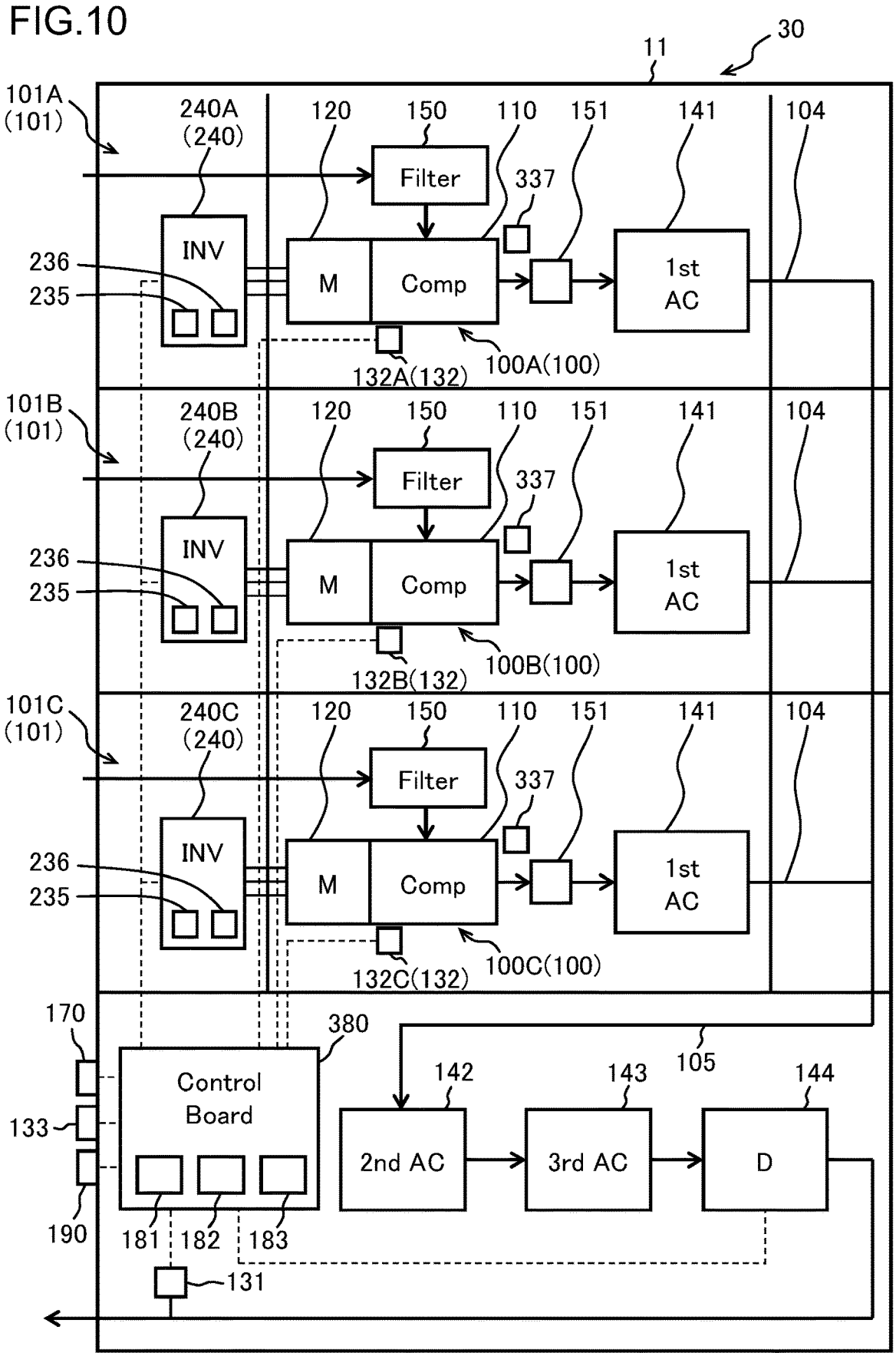
FIG. 10 is a diagram for showing the configuration of a compressor according to a third embodiment.
Figure 11:
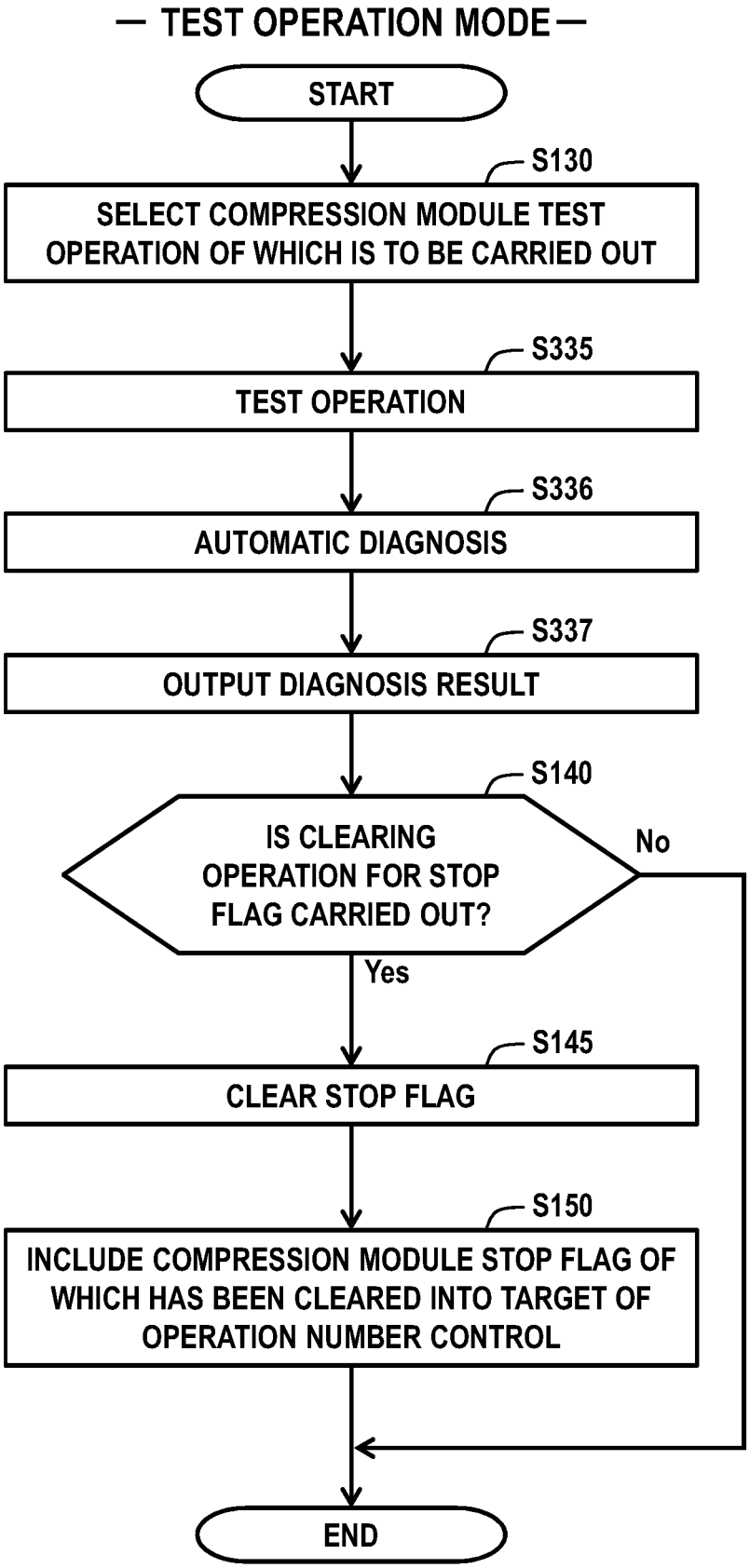
FIG. 11 is a flowchart for showing a content of control when the test operation mode is set by the controller according to the third embodiment.

With reference to FIG. 10 and FIG. 11, a description is now given of a compressor 30 according to a third embodiment of the present invention. Note that, a configuration the same as or corresponding to the configuration described in the second embodiment is assigned with the same reference symbol and a description is mainly given of different points. FIG. 10 is a drawing similar to FIG. 8 and is a diagram for showing a configuration of the compressor 30 according to the third embodiment.

As shown in FIG. 10, the compressor 30 includes microphones 337 as sound acquisition devices each of which acquires the sound generated from the compressor unit 100. The microphone 337 is provided for each compression module 101, converts the acquired sound into an electrical signal (hereinafter referred to as sound data), and outputs the sound data to a controller 380 via a signal line, not shown. The controller 380 determines whether or not an abnormality exists in the compressor unit 100 the test operation processing of which has been carried out, on the basis of the sound generated from the compressor unit 100 the test operation processing of which has been carried out.

FIG. 11 is a drawing similar to FIG. 6 and is a flowchart for showing a content of control when the test operation mode is set by the controller 380 according to the third embodiment. In the flowchart of FIG. 11, in place of Step S135 of the flowchart of FIG. 6, Steps S335, S336, and S337 are carried out.

As shown in FIG. 11, when the controller 380 according to the third embodiment selects the compression module 101 the test operation of which is to be carried out in Step S130, the processing proceeds to Step S335. In Step S335, the controller 380 carries out the test operation processing of causing the motor 120 of the compression module 101 selected in Step S130 to operate for the predetermined time tp. Further, the controller 380 acquires the sound data from the microphone 337 during the test operation processing and causes the nonvolatile memory 182 to store the sound data.

When the test operation processing (Step S335) is completed, the processing proceeds to Step S336. In Step S336, the controller 380 diagnoses whether or not an abnormality exists in the compressor unit 100 for which the test operation processing has been carried out. In this automatic diagnosis processing (Step S336), the controller 380 compares the sound data acquired in Step S335 and is stored in the nonvolatile memory 182 and reference sound data stored in advance in the nonvolatile memory 182 with each other. The reference sound data is sound data measured at the time of, for example, shipping of the compressor 30. The controller 380 determines whether or not the compressor unit 100 has an abnormality on the basis of a result of the comparison between the acquired sound data and the reference sound data. For example, the controller 380 determines that the compressor unit 100 does not have an abnormality when a difference between the frequency of the acquired sound and the frequency of the reference sound data exists within a predetermined allowable range. The controller 380 determines that the compressor unit 100 has an abnormality when the difference between the frequency of the acquired sound and the frequency of the reference sound data exists outside the predetermined allowable range. Note that, the controller 380 may determine that the compressor unit 100 does not have an abnormality when a difference (amplitude difference) between the maximum value of the amplitude of the acquired sound data and the maximum value of the amplitude of the reference sound data exists within a predetermined allowable range, and may determine that the compressor unit 100 has an abnormality when the amplitude difference exists outside the allowable range.

When the automatic diagnosis processing (Step S336) is completed, the processing proceeds to Step S337. In Step S337, the controller 380 causes the display unit 171*a* to display a result of the determination (a result of the diagnosis) in Step S337, and proceeds to Step S140. Note that, the output processing (Step S337) of the diagnosis result may be, in place of the processing of causing the display unit 171*a* to output the diagnosis result, processing of causing a sound output device such as a speaker to output the diagnosis result.

According to the third embodiment, it is possible to automatically diagnose whether or not the compressor unit 100 has an abnormality when the test operation processing is carried out. Thus, the user can easily determine whether or not the stop flag is to be cleared.

Modification Example of Third Embodiment

In the third embodiment, a description is given of the example in which it is determined whether or not an abnormality exists in the compressor unit 100 the test operation processing of which has been carried out, on the basis of the sound generated from the compressor unit 100 the test operation processing of which has been carried out and acquired by the microphone 337, but the present invention is not limited to this example. The controller 380 may determine whether or not an abnormality exists in the compressor unit 100 the test operation processing of which has been carried out, on the basis of the current supplied to the motor 120 of the compressor unit 100 the test operation processing of which has been carried out, that is, the current sensed by the current sensor 236. Moreover, the controller 380 may determine whether or not an abnormality exists in the compressor unit 100 the test operation processing of which has been carried out, on the basis of the temperature of the compressor body 110 of the compressor unit 100 the test operation processing of which has been carried out, that is, the temperature sensed by the temperature sensor 132.

That is, it is only required that the controller 380 is configured to determine whether or not an abnormality exists in the compressor unit 100 the test operation processing of which has been carried out, on the basis of at least any one of the sound generated from the compressor unit 100 the test operation processing of which has been carried out, the current supplied to the motor 120 thereof, and the temperature of the compressor body 110 thereof, and to output a result of the determination. With this configuration, it is possible to automatically diagnose whether or not the compressor unit 100 has an abnormality when the test operation processing is carried out. Thus, the user can easily determine whether or not the stop flag is to be cleared.

Note that, when it is diagnosed that the compressor unit 100 does not have an abnormality by the automatic diagnosis for the compressor unit 100 the test operation processing of which has been carried out, the controller 380 may automatically clear the stop flag. In this case, the clearing operation for the stop flag by the user is not required and hence a time from the test operation to the return to the operation number control can be reduced.

The following modification examples are also within a scope of the present invention, and a configuration described in the modification example and the configuration described in the embodiment described above may be combined with each other, the configurations described in the embodiments described above and different from each other may be combined with each other, or the configurations described in the following modification examples different from each other may be combined with each other.

Modification Example 1

There is such a case in which the first stop condition and the fifth stop condition are satisfied due to erroneous detection of the temperature abnormality and the low-voltage abnormality, respectively. The erroneous detection of the temperature abnormality is generated by the temperature difference ΔT becoming equal to or higher than the temperature threshold value TO, which is caused by, for example, the opening and closing of the door of the room in which the compressor 10, 20, or 30 is installed or an operation of an air conditioner. The erroneous detection of the low-voltage error is generated by, for example, the motor drive voltage V becoming less than the low-voltage threshold value VL, which is caused by control accompanying a large speed change being applied to the motor 120, the rotation of the rotor 122 being incapable of appropriately following the rotating magnetic field generated by the current supplied from the inverter 240 to the stator 121, and hence the step-out occurring. Meanwhile, the second stop condition, the third stop condition, and the fourth stop condition are not satisfied due to the erroneous detection. Thus, the controllers 180, 280, and 380 may determine execution possibility of the test operation processing in correspondence to the stop flag.

When any one of the plurality of stop conditions determined in advance is satisfied, each of the controllers 180, 280, and 380 according to the present modification example sets the stop flag corresponding to the satisfied stop condition, and determines the execution possibility of the test operation processing on the basis of the set stop flag.

A description is now given of an example thereof as a modification example of the second embodiment. As shown in FIG. 12, a relation between each of the stop flags and the execution possibility of the test operation processing is stored in the nonvolatile memory 182 of the controller 280. As shown in FIG. 12, the controller 280 determines that the test operation processing can be carried out when the temperature abnormality stop flag or the low-voltage abnormality stop flag is set, and causes the display unit 171*a* to display this determination. When the operation of starting the test operation is carried out by the operation panel 170 while the temperature abnormality stop flag or the low-voltage abnormality flag is set, the controller 280 sets the test operation mode and carries out the processing shown in the flowchart of FIG. 6.

Meanwhile, when the high-voltage abnormality stop flag is set, the controller 280 determines that the test operation processing cannot be carried out and causes the display unit 171*a* to display this determination. For example, the controller 280 causes the display unit 171*a* to display such a message as "High-voltage abnormality has occurred. Replace check valve 151." or an error code corresponding to this message. When the operation of starting the test operation is carried out by the operation panel 170 while the high-voltage abnormality stop flag is set, the controller 280 causes the display unit 171*a* to display such a fact that the test operation processing cannot be carried out and does not set the test operation mode.

As a result, it is possible to prevent the test operation from being carried out, before the replacement of the check valve 151, for the compression module 101 the high-voltage abnormality of which has been detected. The user stops the entire compressor 20 including the compression modules 101 the abnormality of which is not detected, replaces the check valve 151 of the compression module 101 the abnormality of which has been detected, and carries out the reset operation by the operation panel 170. As a result, the controller 280 clears the high-voltage abnormality stop flag of the compression module 101. Note that, the controller 280 also clears the high-voltage abnormality stop flag when the power supply of the compressor 10 is turned off.

Similarly, when the current abnormality stop flag is set, the controller 280 determines that the test operation processing cannot be carried out and causes the display unit 171*a* to display this determination. For example, the controller 280 causes the display unit 171*a* to display such a message as "Current abnormality has occurred. Repair compressor unit or replace compressor unit." or an error code corresponding to this message. When the operation of starting the test operation is carried out by the operation panel 170 while the current abnormality stop flag is set, the controller 280 causes the display unit 171*a* to display such a fact that the test operation processing cannot be carried out and does not set the test operation mode.

As a result, it is possible to prevent the test operation from being carried out, before the repairment or the replacement of the compressor unit 100, for the compression module 101 the current abnormality of which has been detected. The user stops the entire compressor 20 including the compression modules 101 the abnormality of which is not detected, repairs or replaces the compressor unit 100 of the compression module 101 the abnormality of which has been detected, and carries out the reset operation by the operation panel 170. As a result, the controller 280 clears the current abnormality stop flag of the compression module 101. Note that, the controller 280 also clears the current abnormality stop flag when the power supply of the compressor 10 is turned off.

As described above, according to the present modification example, the controller 280 determines the execution possibility of the test operation, according to the type of the stop flag. Thus, when a predetermined stop flag (for example, the high-voltage abnormality stop flag or the current abnormality flag) is set, the immediate test operation is inhibited and hence the compression module 101 can be prevented from being damaged by the test operation.

Modification Example 2

A description is given of the example in which, in Step S135 of FIG. 6, each of the controllers 180 and 280 causes the motor 120 of the compression module 101 to rotationally operate for the predetermined time tp, and then causes the motor 120 to automatically stop, but the present invention is not limited to this example. The controller 180 may finish the test operation processing (Step S135 of FIG. 6) in response to an operation of the user.

For example, when the stop switch 172*b* of the operation panel 170 is operated when the controller 180 is causing the motor 120 of the compression module 101 to rotationally operate in Step S135 of FIG. 6, the controller 180 causes the motor 120 to stop before the predetermined time tp elapses. With this configuration, the test operation corresponding to the state of the compressor unit 100 can be carried out.

Modification Example 3

A description is given of such a configuration that the shaft 123 of the motor 120 is directly attached to the orbiting scroll 112, and the power of the motor 120 is directly transmitted to the orbiting scroll 112 in the embodiments described above, but the present invention is not limited to this configuration. A pulley may be provided to each of a shaft of the motor 120 and a shaft of the orbiting scroll 112, and a belt which transmits the power generated in the motor 120 to the orbiting scroll 112 may be installed on the pulley of the motor 120 and the pulley of the orbiting scroll 112. With this configuration, when wear or elongation of the belt occurs due to aging degradation, the power required to drive the compressor body 110 increases and hence the motor drive current increases from that at the normal time. That is, when the belt degrades, the current abnormality is detected by the controller 180.

Modification Example 4

The stop conditions are not limited to those described in the embodiments. For example, in the second embodiment, the controller 280 may consider that a stop condition is satisfied when an abnormality is detected in the inverter 240 and may set a stop flag.

Modification Example 5

A description is given of, as an example of the detection of an abnormality by the controller 180, the example of the detection of the abnormality caused by the aging degradation of the tip seals 111*d* and 112*d*, the bearings 124A and 124B, and the wrap portions 111*b* and 112*b* in the first embodiment, but the present invention is not limited to this example. For example, the magnet used in the motor 120 is gradually demagnetized due to aging degradation. Thus, the controller 180 may be configured to detect a current abnormality caused by the aging degradation of the magnet.

Modification Example 6

In the embodiments, a description is given of the example in which each of the compressors 10, 20, and 30 includes the compressor units 100 of the scroll type, but the present invention is not limited to the example. Each of the compressors 10, 20, and 30 may include a plurality of compressor units of the well-known screw type, reciprocating type (piston type), and turbo type. Moreover, the present invention may be applied to a compressor including a plurality of compressor units of types different from one another. For example, the present invention may be applied to a compressor including a controller which controls the operation number of total four compressor units including two compressor units of the scroll type and two compressor units of the reciprocating type.

The embodiments described before simply represent specific examples for helping understanding of the concept of the present invention and do not intend to limit the scope of the present invention. In the embodiments, various components can be added, removed, or replaced without departing from the scope of the purport of the present invention.

The various function sections described in each embodiment may be implemented by using a circuit. The circuit may be a dedicated circuit for implementing the specific function or may be a general-purpose circuit such as a processor.

At least a part of the processing in each embodiment can be implemented by using a general purpose computer as basic hardware. A program for implementing the processing described above may be stored in a computer readable recording medium and may then be provided. The program is stored in the recording medium as an installable file or an executable file. As the recording medium, there are a magnetic disk, an optical disc (CD-ROM, CD-R, DVD, and the like), a magneto-optical disk (MO and the like), a semiconductor memory, and the like. The recording medium may be any recording medium as long as the recording medium can store the program and is computer-readable. Moreover, the program which implement the processing described above may be stored on a computer (server) connected to a network such as the Internet and may be downloaded on a computer (client) via a network.

DESCRIPTION OF REFERENCE CHARACTERS

10, 20, 30: Compressor
100: Compressor unit
101: Compression module
105: Main delivery pipe (pipe)
110: Compressor body
111*b*, 112*b*: Wrap portion
111*d*, 112*d*: Tip seal (seal member)
120: Motor
124A, 124B: Bearing
131: Pressure sensor
132: Temperature sensor
133: Ambient temperature sensor

140: Electromagnetic switch
151: Check valve
170: Operation panel
171*a*, 171*b*: Display unit
172*a*: Run switch (operation switch)
172*b*: Stop switch (operation switch)
172*c*: Menu switch (operation switch)
172*d*: Display changeover switch (operation switch)
180: Controller
181: Processor
182: Nonvolatile memory
183: Volatile memory
190: Communication device
235: Voltage sensor
236: Current sensor
240: Inverter
280: Controller
337: Microphone (sound acquisition device)
380: Controller

The invention claimed is:

1. A compressor comprising:

a compressor unit that includes a compressor body that compresses gas and a motor that drives the compressor body; and a controller that carries out operation number control for a plurality of the compressor units, wherein the plurality of compressor units are connected to a same pipe, and wherein the controller is configured to:

carry out, while continuing the operation number control for the compressor units that are a target of the operation number control, a test operation for the compressor unit excluded from the target of the operation number control to start, determine whether or not the plurality of compressor units have an abnormality, cause the compressor unit that is determined to have the abnormality to stop, and exclude this compressor unit from the target of the operation number control, and cause the compressor unit that is determined to have the abnormality to restart, thereby carrying out the test operation for this compressor unit and to include this compressor unit into the target of the operation number control after the test operation while continuing the operation number control for the compressor unit determined not to have an abnormality.

2. The compressor according to claim 1, wherein the controller is configured to:

set, when the compressor unit is determined to have an abnormality, a stop flag to the compressor unit determined to have the abnormality;

carry out exclusion processing of stopping the compressor unit to which the stop flag is set and excluding the stopped compressor unit from the target of the operation number control while continuing the operation number control for the compressor unit to which the stop flag is not set;

carry out test operation processing of causing the compressor unit to which the stop flag is set to restart and carrying out the test operation for this compressor unit while continuing the operation number control for the compressor unit to which the stop flag is not set;

disable clearing of the setting of the stop flag when the test operation processing has not been completed after carrying out the exclusion processing; and enable the clearing of the setting of the stop flag when the test operation processing has been completed after carrying out the exclusion processing.

3. The compressor according to claim 2, wherein the controller is configured to:

set, when any one of a plurality of stop conditions defined in advance is satisfied, the stop flag corresponding to the satisfied stop condition; and determine execution possibility of the test operation processing on a basis of the set stop flag, and the plurality of stop conditions include a stop condition that is satisfied when the compressor unit has an abnormality.

4. The compressor according to claim 2, wherein, when the setting of the stop flag of the compressor unit excluded from the target of the operation number control is cleared while the operation number control for the compressor unit that is the target of the operation number control is being carried out, the compressor unit the setting of the stop flag of which is cleared is included into the target of the operation number control while continuing the operation number control.

5. The compressor according to claim 1, wherein the compressor includes an electromagnetic switch that switches between supply and interrupt of electric power to the motor, and the controller is configured to supply, in the test operation for the compressor unit excluded from the target of the operation number control, the electric power to the motor by the electromagnetic switch, thereby causing the compressor unit excluded from the target of the operation number control to operate at a constant speed for a predetermined time and to then cause this compressor unit to stop.

6. The compressor according to claim 1, wherein the compressor includes an inverter that supplies electric power to the motor, and the controller is configured to cause, in the test operation for the compressor unit excluded from the target of the operation number control, the motor of the compressor unit excluded from the target of the operation number control to operate at a lowest speed for a predetermined time and to then cause the motor to stop.

7. The compressor according to claim 1, wherein the compressor includes an inverter that supplies electric power to the motor, and the controller is configured to, in the test operation for the compressor unit excluded from the target of the operation number control, gradually increase a rotational speed of the motor of the compressor unit excluded from the target of the operation number control from a lowest speed to a predetermined speed as time elapses.

8. The compressor according to claim 1, wherein the controller is configured to carry out, when a plurality of the compressor units excluded from the target of the operation number control exist, one at a time, the test operation for the plurality of compressor units excluded from the target of the operation number control.

9. The compressor according to claim 2, wherein the controller is configured to determine whether or not the compressor unit the test operation processing of which has been carried out has an abnormality, on a basis of any one of sound generated from the compressor unit the test operation processing of which has been carried out, a current supplied to the motor thereof, and temperature of the compressor body thereof.

10. A compressor comprising:

an electromagnetic switch that switches between supply and interrupt of electric power to the motor;

a compressor unit that includes a compressor body that compresses gas and a motor that drives the compressor body; and a controller that carries out operation number control for a plurality of the compressor units, wherein the plurality of compressor units are connected to a same pipe, and wherein the controller is configured to:

carry out, while continuing the operation number control for the compressor units that are a target of the operation number control, a test operation for the compressor unit excluded from the target of the operation number control to start, and supply, in the test operation for the compressor unit excluded from the target of the operation number control, the electric power to the motor by the electromagnetic switch, thereby causing the compressor unit excluded from the target of the operation number control to operate at a constant speed for a predetermined time and to then cause this compressor unit to stop.

11. A compressor comprising:

a compressor unit that includes a compressor body that compresses gas and a motor that drives the compressor body;

an inverter that supplies electric power to the motor; and a controller that carries out operation number control for a plurality of the compressor units, wherein the plurality of compressor units are connected to a same pipe, and wherein the controller is configured to:

carry out, while continuing the operation number control for the compressor units that are a target of the operation number control, a test operation for the compressor unit excluded from the target of the operation number control to start, and cause, in the test operation for the compressor unit excluded from the target of the operation number control, the motor of the compressor unit excluded from the target of the operation number control to operate at a lowest speed for a predetermined time and to then cause the motor to stop.

* * * * *